US012037997B2

(12) United States Patent
Krug

(10) Patent No.: US 12,037,997 B2
(45) Date of Patent: Jul. 16, 2024

(54) ROD PUMPING SURFACE UNIT

(71) Applicant: David A. Krug, Cedar Hills, UT (US)

(72) Inventor: David A. Krug, Cedar Hills, UT (US)

( * ) Notice: Subject to any disclaimer, the term of this patent is extended or adjusted under 35 U.S.C. 154(b) by 203 days.

(21) Appl. No.: 17/711,719

(22) Filed: Apr. 1, 2022

(65) Prior Publication Data

US 2022/0341413 A1 Oct. 27, 2022

Related U.S. Application Data

(60) Provisional application No. 63/313,157, filed on Feb. 23, 2022, provisional application No. 63/299,793, filed on Jan. 14, 2022, provisional application No. 63/178,445, filed on Apr. 22, 2021.

(51) Int. Cl.

| | |
|---|---|
| ***F04B 47/04*** | (2006.01) |
| ***F04B 47/02*** | (2006.01) |
| *E21B 43/12* | (2006.01) |

(52) U.S. Cl.

CPC ..... *F04B 47/04* (2013.01); *F04B 47/022* (2013.01); *E21B 43/127* (2013.01)

(58) Field of Classification Search

CPC ..... E21B 43/126; E21B 43/127; E21B 47/009
See application file for complete search history.

(56) References Cited

U.S. PATENT DOCUMENTS 2,081,921 A * 6/1937 Gartin ..... E21B 7/02 92/9
2,520,187 A * 8/1950 Wilshusen ..... B26D 7/06 74/37
4,062,640 A 12/1977 Gault
4,187,680 A * 2/1980 Sanford ..... F04B 47/04 60/381
5,044,888 A 9/1991 Hester, II
5,182,946 A 2/1993 Boughner et al.
5,252,031 A 10/1993 Gibbs
5,281,109 A * 1/1994 Bender ..... F04B 47/14 417/415
5,458,466 A 10/1995 Mills
5,481,873 A 1/1996 Saruwatari et al.
5,710,699 A 1/1998 King et al.
5,823,262 A 10/1998 Dutton
5,829,530 A 11/1998 Nolen
(Continued)

*Primary Examiner* — David Carroll
(74) *Attorney, Agent, or Firm* — Peter L. Brewer; Thrive IP

(57) ABSTRACT

An oil well pumping unit. The pumping unit has a vertical support column residing adjacent a horizontal support base at a generally transverse orientation. The pumping unit has a standing sheave fixed proximate an upper end of the vertical support column, a carrier bar configured to be attached to a polished rod along the front face of the vertical support column, and a traveling sheave configured to move up and down along the vertical support column. A near-vertical actuator resides along the horizontal support base, and is connected to the traveling sheave. Cyclical movement of the linear actuator causes the traveling sheave to reciprocate up and down along the vertical support column such that upward movement of the traveling sheave produces a downstroke of the polished rod, while downward movement of the traveling sheave produces an upstroke of the polished rod. The linear actuator remains in tension at all times during movement of the polished rod.

37 Claims, 26 Drawing Sheets

(56) References Cited

U.S. PATENT DOCUMENTS

| | | | | |
|---|---|---|---|---|
| 6,094,910 | A * | 8/2000 | Vatne | E21B 19/086 91/519 |
| 7,168,924 | B2 | 1/2007 | Beck et al. | |
| 7,373,971 | B2 | 5/2008 | Montgomery | |
| 7,437,215 | B2 | 10/2008 | Anderson et al. | |
| 7,530,799 | B2 | 5/2009 | Smith | |
| 7,878,250 | B2 | 2/2011 | Sheldon | |
| 8,066,496 | B2 | 11/2011 | Brown | |
| 8,083,499 | B1 | 12/2011 | Krug et al. | |
| 8,562,308 | B1 | 10/2013 | Krug et al. | |
| 8,597,003 | B2 | 12/2013 | Krug et al. | |
| 8,844,626 | B1 | 9/2014 | Krug | |
| 8,955,582 | B2 | 2/2015 | Wang et al. | |
| 9,429,001 | B2 | 8/2016 | Best | |
| 9,651,124 | B2 | 5/2017 | Gu | |
| 9,803,657 | B2 | 10/2017 | Froehlich et al. | |
| 9,903,361 | B2 | 2/2018 | Xiang | |
| 10,107,295 | B1 | 10/2018 | Brecheisen | |
| 10,113,544 | B2 | 10/2018 | Robison et al. | |
| 10,196,883 | B2 | 2/2019 | Robison et al. | |
| 10,197,050 | B2 | 2/2019 | Robison et al. | |
| 10,400,761 | B2 | 9/2019 | Robison et al. | |
| 10,612,537 | B2 | 4/2020 | Hodges et al. | |
| 10,844,852 | B2 | 11/2020 | Robison et al. | |
| 10,890,193 | B2 | 1/2021 | Trottmann | |
| 10,962,000 | B2 | 3/2021 | Robison et al. | |
| 2003/0151875 | A1 | 8/2003 | Nguyen et al. | |
| 2004/0139149 | A1 | 7/2004 | De Sousa et al. | |
| 2005/0283277 | A1 | 12/2005 | Schulz | |
| 2006/0149476 | A1 | 7/2006 | Gibbs et al. | |
| 2007/0020110 | A1 | 1/2007 | Mills | |
| 2007/0286750 | A1 | 12/2007 | Beck et al. | |
| 2008/0010020 | A1 | 1/2008 | Ellender et al. | |
| 2008/0314581 | A1 | 12/2008 | Brown | |
| 2009/0024442 | A1 | 1/2009 | Brink et al. | |
| 2009/0024443 | A1 | 1/2009 | Graham et al. | |
| 2009/0055029 | A1 | 2/2009 | Roberson et al. | |
| 2009/0125367 | A1 | 5/2009 | Brink et al. | |
| 2009/0276100 | A1 | 11/2009 | Malki et al. | |
| 2011/0240937 | A1 | 10/2011 | McEwan et al. | |
| 2013/0024138 | A1 | 1/2013 | Mills | |
| 2014/0205466 | A1 | 7/2014 | Best | |
| 2015/0292307 | A1 | 10/2015 | Best | |
| 2015/0337648 | A1 | 11/2015 | Zippel et al. | |

* cited by examiner

ROD PUMPING SURFACE UNIT

CROSS REFERENCE TO RELATED APPLICATIONS

This application claims the benefit of U.S. Ser. No. 63/178,445 filed Apr. 22, 2021. That application is entitled "ULRPSU Ultra-Long Rod Pump Surface Unit."

This application also claims the benefit of U.S. Ser. No. 63/299,793 filed Jan. 14, 2022. That application is entitled "Rod Pumping Surface Unit."

This application also claims the benefit of U.S. Ser. No. 63/313,157 filed Feb. 23, 2022. That application is also entitled "Rod Pumping Surface Unit."

Each of these provisional patent applications is incorporated herein in its entirety by reference.

STATEMENT REGARDING FEDERALLY SPONSORED RESEARCH OR DEVELOPMENT

Not applicable.

BACKGROUND OF THE INVENTION

This section is intended to introduce various aspects of the art, which may be associated with exemplary embodiments of the present disclosure. This discussion is believed to assist in providing a framework to facilitate a better understanding of particular aspects of the present disclosure. Accordingly, it should be understood that this section should be read in this light, and not necessarily as admissions of prior art.

Field of the Invention

The present disclosure relates to the field of hydrocarbon recovery operations. More specifically, the present invention relates to pumping systems for the production of hydrocarbon fluids, and to the optimization of operating cycles for a reciprocating downhole pump. Further still, the invention relates to a pumping system having an ultra-long stroke length.

Technology in the Field of the Invention

In the drilling of oil and gas wells, a wellbore is formed using a drill bit that is urged downwardly at a lower end of a drill string. After drilling to a predetermined depth, the drill string and bit are removed and the wellbore is lined with a string of casing. An annular area is thus formed between the string of casing and the surrounding formation.

Particularly in a vertical wellbore, or the vertical section of a horizontal well, a cementing operation is conducted in order to fill or "squeeze" part or all of the annular area with cement. The combination of cement and casing strengthens the wellbore and facilitates the zonal isolation, and subsequent completion, of certain sections of potentially hydrocarbon-producing pay zones behind the casing.

In completing a wellbore, it is common for the drilling company to place a series of casing strings having progressively smaller outer diameters into the wellbore. These include a string of surface casing, at least one intermediate string of casing, and a production casing. The process of drilling and then cementing progressively smaller strings of casing is repeated until the well has reached total depth. In some instances, the final string of casing is a liner, that is, a string of casing that is not tied back to the surface. The final string of casing, referred to as a production casing, is also typically cemented into place.

To prepare the wellbore for the production of hydrocarbon fluids, a string of tubing is run into the casing. This tubing is referred to as a production tubing. A packer is set at a lower end of the production tubing to seal an annular area formed between the tubing and the surrounding strings of casing. The tubing then becomes a string of production pipe through which hydrocarbon fluids may be lifted.

In order to carry the hydrocarbon fluids to the surface, a pump may be placed at a lower end of the production tubing. This is known as "artificial lift." In some cases, the pump may be an electrical submersible pump, or ESP. ESP's utilize a hermetically sealed motor that drives a multi-stage pump. The downside to ESP's is that an electrical power line is required to be run from the surface, down the wellbore, and to the pump. In addition, ESP's draw large amounts of power. If electrical connectivity is somehow lost along the power line, the ESP no longer works.

More conventionally, oil wells undergoing artificial lift use a downhole reciprocating plunger-type pump. The pump has one or more valves that capture fluid on a down stroke, and then lift the fluid on the upstroke. This is known as "positive displacement." In some designs such as that disclosed in U.S. Pat. No. 7,445,435, the pump is able to both capture and lift fluid on each of the down stroke and the upstroke.

Conventional positive displacement pumps define a moving, or "traveling," valve, that is reciprocated at the end of a "rod string." The rod string comprises a series of long, thin joints of solid rods (referred to colloquially as sucker rods) that are typically threadedly connected through couplings. The rod string is attached to a pumping unit at the surface. The pumping unit causes the rod string to move up and down within the production tubing to incrementally lift production fluids from subsurface intervals to the surface.

FIG. 1 is a somewhat schematic view of an oil well pumping system 100 as is known in the oil and gas industry. The oil well pumping system 100 is used for producing hydrocarbon fluids from a subsurface formation, and up to a surface 150 at a well site. Water, natural gas and other fluids may also be incidentally produced at the well site through a wellhead 110.

In FIG. 1, the illustrative oil well pumping system 100 is a so-called beam pumping unit. The beam pumping unit 100 includes a horse head 120 that reciprocates over a wellbore (partially shown at 170). The horse head 120 is connected to a walking beam 122. The walking beam 122, in turn, pivots about a fulcrum 124 in a cyclical manner.

The horse head 120 supports a polished rod 130. The horse head 120 and polished rod 130 are mechanically tethered by means of a harness system 135 (sometimes referred to as a "bridle"). Suitable packing is provided along the polished rod 130 to prevent production fluids from leaking out of the wellhead 110.

The polished rod 130 supports a plurality of so-called sucker rods 132 from the surface 150. Multiple sucker rod joints 132 extend down into the wellbore 170 in order to support the downhole pump (not shown). Each sucker rod is typically 25 to 35 feet in length, and resides within a string of production tubing 145. The production tubing 145, in turn, resides within strings of casing 125. It is understood that the rod string 132 may extend over 5,000 feet, or over 7,000 feet, from the surface 150.

In order to induce reciprocation of the horse head 120 and connected polished rod 130 (and sucker rods 132 and downhole pump), a prime mover 140 is provided. In the illustrative system 100 of FIG. 1, the prime mover 140 is an electric motor that turns a rotating drive shaft. The electric (or other) motor and drive shaft transfer rotational motion to a pair of heavy, counter-weighted fly-wheels 142. The fly-wheels 142, in turn, are pivotally connected to pumping arms 144, or so-called "crank arms." The crank arms 144, finally, are pivotally connected to an end of the walking beam 122 that is opposite the horse head 120. Movement of the crank arms 144 creates the reciprocating motion of the horse head 120 and suspended hardware. A further description of a walking beam unit is provided in U.S. Pat. No. 7,500,390 (issued to Weatherford/Lamb, Inc.), which is incorporated herein in its entirety by reference.

It is understood that the pumping system 100 of FIG. 1 is just one of several ways known for reciprocating sucker rods and a downhole pump from the surface 150. In many instances, the pumping unit operates using a combustion engine as the prime mover. In some instances, a hydraulic actuator system is used.

Sucker rod pumping is the most widely used means for artificially lifting oil wells. Those of ordinary skill in the art will understand that, during reciprocation, the long sucker rod string undergoes tension and compression forces, creating strain along the metal or fiberglass sucker rod string. Strain waves travel at the acoustical velocity in the rod material at about 16,000 feet/second. These strain waves can be detected at the surface by means of a load cell, and converted into histograms. The histograms are presented, either physically or digitally, on so-called dynamometer cards. The dynamometer cards are then analyzed to understand downhole operating conditions.

The speed at which the rod string 132 and connected pump move up and down in the wellbore 170 may be controlled through a so-called pump-off controller. FIG. 1 shows a master control box 180. The control box 180 will house a so-called pump-off controller. The pump-off controller generates the dynamometer cards based on various surface readings including load cell readings from a polished rod transducer having an accelerometer. Dynamometer card readings may also be based on the electric motor amperage from clamp-on amp probes, current transformers or other methods of monitoring amperage.

In any instance, the process of cyclically lifting and lowering the rod string 132 and connected pump causes frictional wear between the rod string and the surrounding production tubing 145. Those of ordinary skill in the art will understand that wellbores are never perfectly vertical. The frictional engagement between the rod string and the production tubing can create holes in the tubing, particularly along areas of cork screw, which in turn leak into the annulus around the tubing. Some in the industry derisively refer to the rod string as a "hacksaw."

Therefore, a need exists for a rod pumping system that provides for a longer stroke length, thereby reducing the number of stroke cycles required to produce the same amount of oil as a conventional pumping unit. This, in turn, reduces the frictional wear applied to the production tubing. Further, a need exists for such a pumping system that utilizes the mechanical advantage offered by sheaves, thereby increasing the efficiency of the pumping unit. Still further, a need exists for such a pumping system where movement of the sheaves and the connected polished rod can be stopped, started, or held in place at any given moment by the pump-off controller, or manually by an operator.

BRIEF SUMMARY OF THE INVENTION

An oil well pumping unit is first provided herein. The oil well pumping unit is designed to move a polished rod up and down, cyclically, through a well head above a wellbore. A long string of sucker rods is connected to the polished rod, and moves up and down within the wellbore in response to movement of the polished rod. In addition, a so-called traveling valve is connected at the bottom of the sucker rod string, which is part of a downhole pump.

In one embodiment, the oil well pumping unit first comprises a horizontal support base. The horizontal support base is preferably fabricated from steel, and may comprise a metal frame. The horizontal support base may optionally be placed onto or secured to a cement pad. Preferably, the metal frame is bolted into the cement pad to form an integral support base system. In one aspect, the pad is mounted onto helical piers that extend into the ground.

The oil well pumping unit also includes a vertical support column. The vertical support column resides adjacent the horizontal support base at a generally transverse orientation. In one aspect, the vertical support column has a lower end that is affixed to the frame portion of the horizontal support base. Preferably, the horizontal support base and the vertical support column are connected by means of a hinged connection so that the vertical support column may be folded over onto the horizontal support base. This allows a service company to access the wellbore for workovers and other service without repositioning the horizontal support column away from the well. This also facilitates transport and storage of the pumping unit as the vertical support column may be very tall.

The vertical support column has a front face and a back face. The front face is designed to face towards the wellbore while the back face is away from the wellbore. Note that this is in contrast to known pumping units that use a structure positioned or extending directly over the wellbore.

The oil well pumping unit further comprises a standing sheave. The standing sheave is fixed proximate an upper end of the vertical support column. Preferably, the standing sheave comprises a pair of wheels located at the top of the vertical support column and sharing a common axle. Preferably, the upper end of the vertical support column comprises a crown. The crown supports an axle shared by the pair of wheels making up the standing sheave. Thus, the axle is rotationally connected to the crown.

In addition, the oil well pumping unit has at least one sheave configured to move up and down along the vertical support column. This sheave serves as a traveling sheave. Preferably, the traveling sheave also comprises a pair of wheels that also share a common axle. The traveling sheave resides and moves along the back face of the vertical support column. Preferably, each of the wheels of the standing sheave has a radius that is larger than a radius of each of the wheels of the traveling sheave.

The oil well pumping unit also includes a near-vertical linear actuator. The vertical linear actuator is preferably anchored along a bottom plate of the vertical support column and extends up the back face. The linear actuator has a distal end that moves cyclically away from and back towards the bottom plate.

In one aspect, the linear actuator comprises a hydraulic cylinder. The hydraulic cylinder is made up of a barrel and a reciprocating plunger, with the plunger being connected to a piston rod. Cyclical movement of the plunger and connected piston rod is imparted by pumping fluid, under pressure, into the barrel using a hydraulic pump. Alternatively, the linear actuator may be driven by a linear electric motor, an electrical roller screw drive.

In any embodiment, the linear actuator is designed to move the traveling sheave along the back face of the vertical support column, up and down. In one aspect, the upper end of the piston rod is operatively connected to an axle of the wheels that make up the traveling sheave.

The oil well pumping unit also includes a carrier bar. The carrier bar is configured to be attached to the polished rod along the front face of the vertical support column, such as through the use of a polished rod clamp.

The oil well pumping unit further includes at least two ropes. Preferably, these are wire ropes. Each of the wire ropes is connected at a first end to the carrier bar. The wire ropes are then wound over the standing sheave, and then wound under the traveling sheave. Preferably, a second end of the wire ropes is then pinned to an upper end of the vertical support column.

In operation, the cyclical movement of the linear actuator causes the traveling sheave to reciprocate up and down along the back face of the vertical support column. An upward movement of the traveling sheave produces a downstroke of the polished rod, while a downward movement of the traveling sheave produces an upstroke of the polished rod. As designed, the second end of the linear actuator remains in tension at all times during movement of the polished rod. As designed, the traveling sheave arrangement produces a 2:1 amplification of travel.

In a preferred arrangement, each of the polished rod, the axle of the traveling sheave and the axle of the standing sheave has a vertical center-line, with each center-line being offset from the other. The center-line of the traveling sheave is proximate the back face of the vertical support column, while the center-line of the polished rod is over the wellbore. The center-line of the standing sheave is somewhere in between, and along the vertical support column.

In a preferred embodiment, the oil well pumping unit also includes a controller. The controller is programmed to control movement of the linear actuator by (i) sending signals to start and stop movement of the linear actuator, and (ii) sending signals to control a speed of the upstroke of the polished rod, a speed of the downstroke of the polished rod, or both. In one aspect, the controller is configured to control the downstroke speed of the polished rod within established minimum and maximum downstroke speeds, and to control the upstroke speed of the polished rod within established minimum and maximum upstroke speeds. The controller may also adjust stroke length within defined limits.

In one embodiment, the controller autonomously detects both compressible and non-compressible pump fillage plus leakage rates downhole. By using a fluid pressure transducer, the controller is able to detect load changes as seen by the polished rod as it reciprocates above the wellbore. The system detects both polished rod position and supported load throughout the entirety of stroke travel, using sensors for pump optimization. In one aspect, a position sensor is associated with the polished rod or, optionally, with a vertical actuator. The controller is able to move the traveling valve to a position of close proximity to the standing valve in the wellbore on the downstroke, thereby improving the capture of fluids.

A method of producing oil using a surface rod pumping unit is also provided. In one aspect, the method first comprises providing a surface rod pumping unit. The surface rod pumping unit may be designed in accordance with the oil well pumping unit described above in its various embodiments. For example, the surface rod pumping unit may comprise:

a horizontal support base;

a vertical support column residing adjacent the horizontal support base at a generally transverse orientation, the vertical support column having a front face and a back face;

a standing sheave fixed proximate an upper end of the vertical support column;

a carrier bar configured to be attached to a polished rod along the front face;

a traveling sheave configured to roll up and down along the vertical support column, with the traveling sheave having an axle that resides along the back face;

a near-vertical linear actuator residing along the back face of the vertical support column, with the linear actuator having a proximal end anchored to a bottom of the vertical support column, and a distal end operatively connected to the axle of the traveling sheave; and at least two ropes connected at a first end to the carrier bar, wound over the standing sheave, and then wound under or connected to the traveling sheave.

Preferably, the standing sheave comprises a pair of wheels rotationally supported at the upper end of the vertical support column, while the traveling sheave also comprises a pair of wheels. The pair of wheels making up the standing sheave rotate together about an axis of rotation through the vertical center-line of the standing sheave, while the pair of wheels making up the traveling sheave rotate together about an axis of rotation through the vertical center-line of the traveling sheave. These two center-lines are offset from one another, providing load balancing along the vertical support column.

Upward movement of the linear actuator causes the traveling sheave to travel to an upper end of the vertical support column, defining a raised position. In one aspect, when the traveling sheave is in its raised position, the wire ropes form an angle that is between 4° and 8° relative to a center-line of the vertical support column. Downward movement of the linear actuator causes the traveling sheave to travel to a lower end of the vertical support column, defining a lowered position. In one aspect, when the traveling sheave is in its lowered position, the wire ropes form an angle that is between 1° and 4° relative to the center-line of the vertical support column.

Of interest, the second end of the linear actuator remains in tension at all times during movement of the traveling sheave and operatively connected polished rod. Preferably, each of the at least two ropes is a wire rope that has a second end opposite the first end. The second end is pinned to the vertical support column proximate an upper end of the vertical support column.

The method also includes cycling the linear actuator. In this arrangement, cycling the linear actuator causes the traveling sheave to reciprocate up and down along the back face of the vertical support column such that upward movement of the traveling sheave produces a downstroke of the polished rod, while downward movement of the traveling sheave produces an upstroke of the polished rod. Preferably, the distance of travel of the polished rod in each direction is at least 400 inches and, more preferably, at least 480 inches.

DESCRIPTION OF THE DRAWINGS

So that the manner in which the present inventions can be better understood, certain illustrations, charts and/or flow charts are appended hereto. It is to be noted, however, that the drawings illustrate only selected embodiments of the inventions and are therefore not to be considered limiting of scope, for the inventions may admit to other equally effective embodiments and applications.

FIGS. 2D-1 and 2D-2 are enlarged perspective views of the standing sheave and the traveling sheave from FIG. 2C. Each sheave is supported at least in part by a vertical support column.

In FIG. 2D-1, the standing sheave is shown as a pair of wheels, and the traveling sheave is also shown as a pair of sheaves.

In FIG. 2D-2, one of the wheels of each of the standing sheave and the traveling sheave is removed, revealing the axles and support rollers.

FIGS. 3D-1 and 3D-2 are perspective views of the standing sheave and the traveling sheave from FIG. 3A. Each sheave is again supported by the vertical support column.

In FIG. 3D-1, the standing sheave is shown as a pair of wheels, and the traveling sheave is also shown as a pair of wheels.

In FIG. 3D-2, one of the wheels of each of the standing sheave and the traveling sheave is removed, revealing the axles and support rollers. The polished rod is also visible.

DEFINITIONS

For purposes of the present application, it will be understood that the term "hydrocarbon" refers to an organic compound that includes primarily, if not exclusively, the elements hydrogen and carbon. Hydrocarbons may also include other elements, such as, but not limited to, halogens, metallic elements, nitrogen, oxygen, and/or sulfur.

As used herein, the term "hydrocarbon fluids" refers to a hydrocarbon or mixtures of hydrocarbons that are gases or liquids. For example, hydrocarbon fluids may include a hydrocarbon or mixtures of hydrocarbons that are gases or liquids at formation conditions or at surface conditions. Hydrocarbon fluids may include, for example, oil, natural gas, coalbed methane, shale oil, pyrolysis oil, pyrolysis gas, a pyrolysis product of coal, and other hydrocarbons that are in a gaseous or liquid state, or combination thereof.

As used herein, the term "wellbore fluids" means water, hydrocarbon fluids, formation fluids, or any other fluids that may be within a wellbore during a production operation. Wellbore fluids may include a weighting agent that is residual from drilling mud.

As used herein, the term "wellbore" refers to a hole in the subsurface made by drilling or insertion of a conduit into the subsurface. A wellbore may have a substantially circular cross section. The term "well," when referring to an opening in the formation, may be used interchangeably with the term "wellbore."

As used herein, the term "hydraulic pressure" when used in connection with the movement of a piston rod includes hydraulic pressure produced by a hydraulic pump, including changes in pressurized fluid flow rate.

DETAILED DESCRIPTION OF SELECTED SPECIFIC EMBODIMENTS

The novel characteristic of the embodiments of the present application are set forth in the appended claims. However, the embodiments themselves and further objectives and advantages thereof, will best be understood by reference to the following detailed description when read in conjunction with the accompanying drawings, wherein:

An oil well pumping unit is provided. The oil well pumping unit is designed to move a polished rod up and down, cyclically, above a wellbore. A long string of sucker rods is operatively connected to the polished rod, and moves up and down within the wellbore in response to movement of the polished rod. For this reason, the pumping unit is referred to herein as a rod pumping unit.

It is understood that a downhole pump is attached to a lower end of the sucker rod string. The downhole pump represents a so-called traveling valve and plunger. The traveling valve operates in conjunction with a standing valve, which is secured within the production tubing downhole. Typically, the standing valve frictionally resides within a seating nipple (not shown).

Figure 2A:
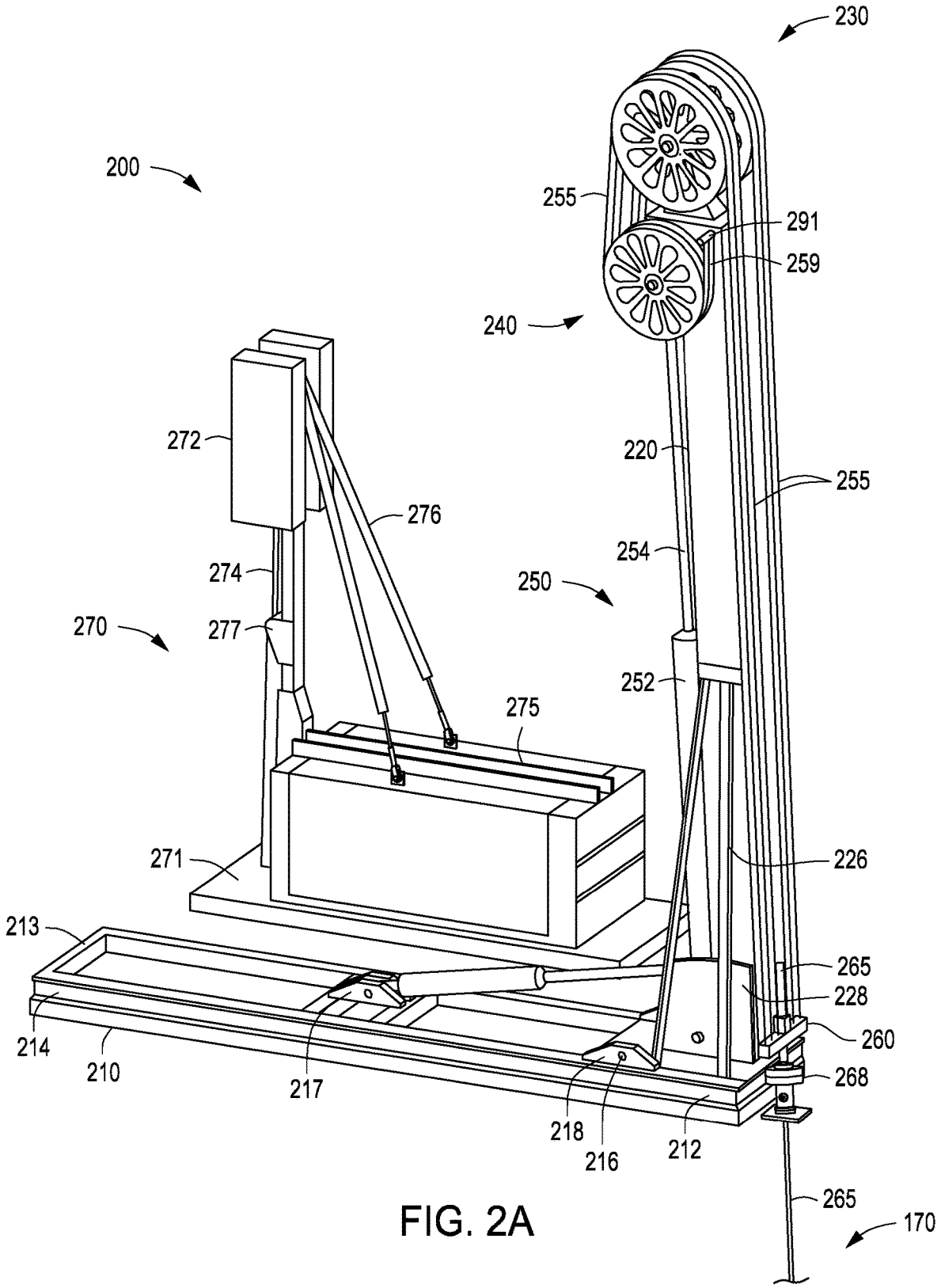
FIG. 2A is a perspective view of a rod pumping unit of the present invention, in one embodiment. In this view, the traveling sheave is in its raised position, and the operatively connected polished rod is in its lowered position. Also visible is an optional counter-weight powerhouse system.

FIG. 2A is a perspective view of a rod pumping unit 200 of the present invention, in one embodiment. The rod pumping unit 200 is uniquely designed to cycle a polished rod through a long (or, more accurately, an ultra-long) stroke length. The stroke length may be anywhere between 60 inches all the way up to 600 inches or more depending on the size of the unit 200 and the settings on its controller. In a preferred embodiment, the stroke length is at least 400 inches and, more preferably, at least 480 inches.

Figure 2B:
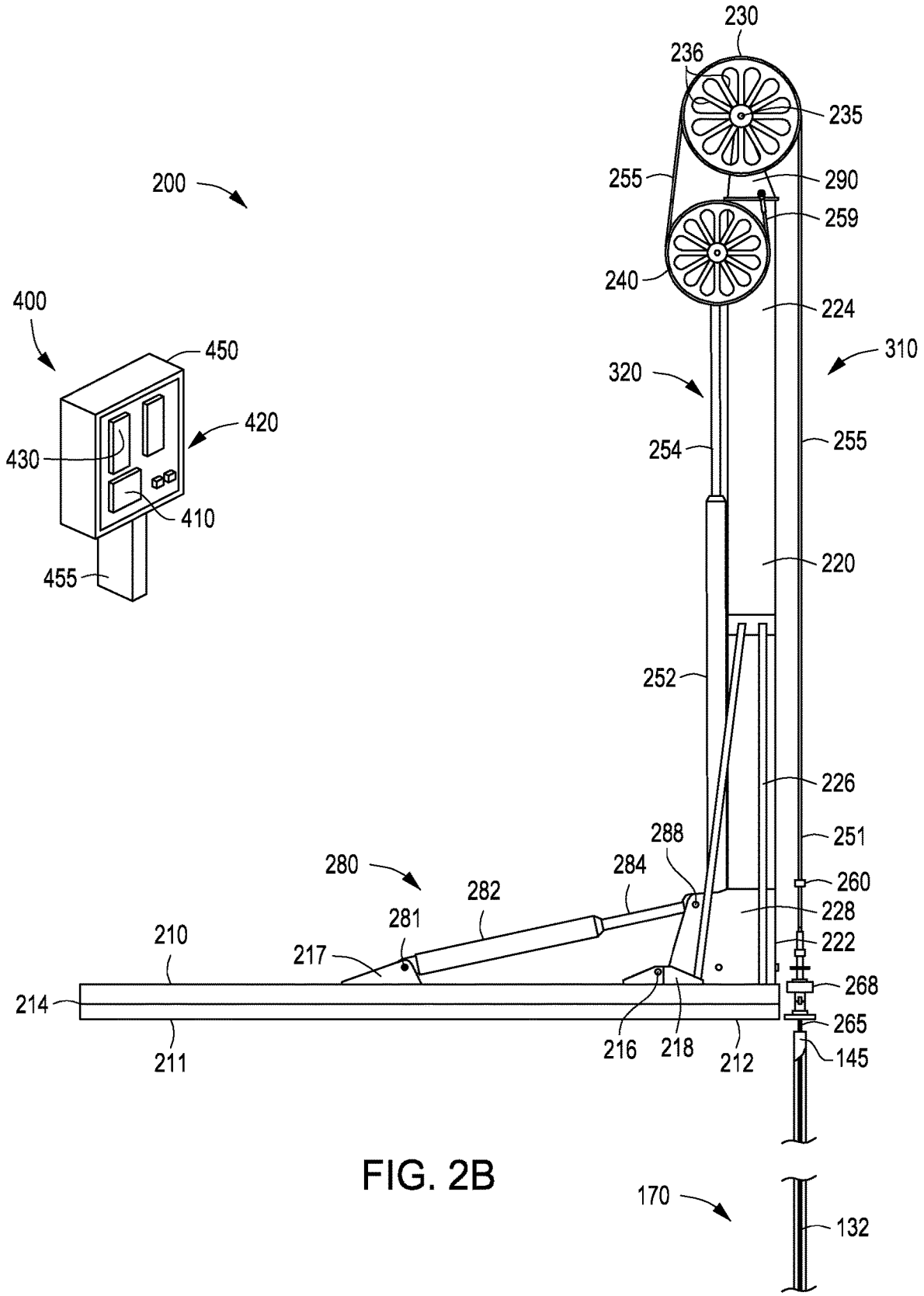
FIG. 2B is a side view of the rod pumping unit of FIG. 2A. Also shown is an illustrative control panel box having a master controller.
Figure 2C:
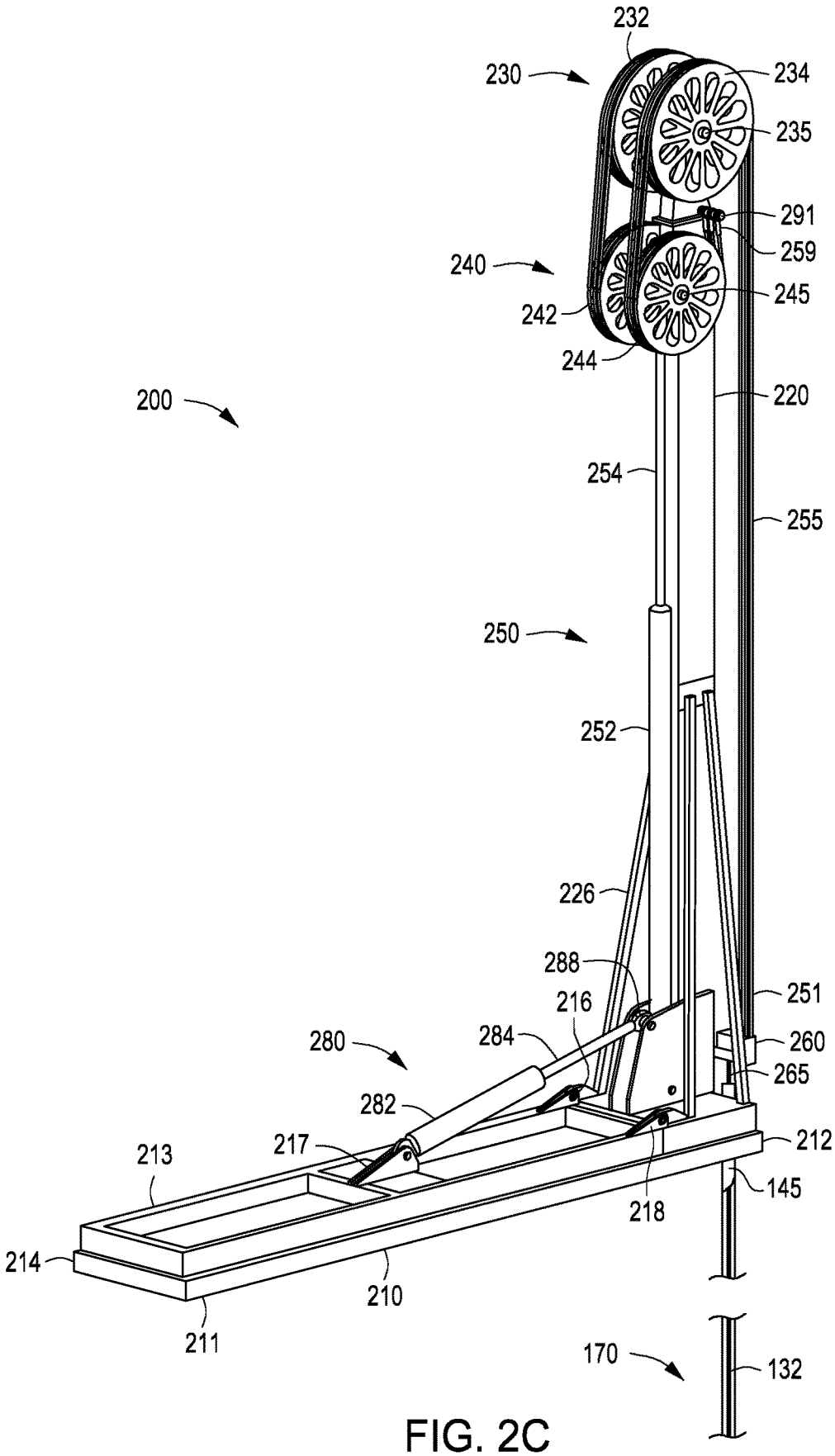
FIG. 2C is another perspective view of the rod pumping unit of FIG. 2A. The counter-weight powerhouse system and the control panel box have been removed for clarity.

FIG. 2B is a side view of the rod pumping unit of FIG. 2A. FIG. 2C is another perspective view of the rod pumping unit of FIG. 2A The rod pumping unit 200 will be initially described with reference to each of FIGS. 2A, 2B and 2C, together.

The rod pumping unit 200 first comprises a horizontal support base 210. The horizontal support base 210 defines an elongated metal frame (seen at 213 in FIG. 2C and also in FIG. 8). The horizontal frame 213 preferably sits on a concrete pad 211, with the frame 213 being bolted onto the concrete pad 211. In this way, the horizontal support base 210 can be removed and transported from the well site. In one aspect, the pad 211 is mounted onto helical piers (or pilings, not shown) that extend into the ground.

The concrete pad 211 is preferably between 40 and 50 feet in length, though a smaller form could be employed where the concrete pad 211 is secured in the ground using pilings. The frame 213 is between 35 and 45 feet in length, in a preferred embodiment.

The frame 213 comprises a proximal end 212 and a distal end 214. A pair of brackets 217, 218 are welded (or otherwise secured onto) the frame 213. The first bracket 217 resides intermediate the proximal 212 and distal 214 ends of the frame 213, while the second bracket 218 resides along the proximal end 212 of the frame 213. The frame 213 and its brackets 217, 218 are preferably fabricated from steel.

The rod pumping unit 200 also includes a vertical support column 220. The vertical support column 220 resides adjacent the horizontal support base 210 at a generally transverse orientation. In one aspect, the vertical support column 220 extends 45 feet above the ground, or 65 feet above the ground, or even 100 feet above the ground, to accommodate the long polished rod 265. In one aspect, the polished rod 265 is carried through a 40-foot travel.

The vertical support column 220 also has a proximal end 222 and a distal end 224. The vertical support column 220 may be a so-called I-Beam (or, optionally, a W-Beam or other fabricated beam) having a front face 310 and a back face 320. The front face 310 faces towards the wellbore 170 while the back face 320 is away from the wellbore 170. Note that this is in contrast to known pumping units that use a vertical structure positioned directly over the wellbore and using bridles or belts.

The vertical support column 220 is a fixed, rigid member that supports the dead weight being lifted and lowered. In one aspect, the vertical support column 220 is fabricated using a combination of plate, bar, and angle gusset material to stiffen side members of the support column 220 so as to prevent buckling.

The proximal end 222 of the vertical support column 220 defines a bottom plate 227. The bottom plate 227 is essentially the bottom of the I-Beam or other structure making up the vertical support column 220. When the vertical support column 220 is in its raised position, the bottom plate 227 gravitationally rests on the cement pad 211.

The vertical support column 220 also includes a pair of base plates 228. The base plates 228 are welded onto the bottom plate 227 along the major axis of the vertical support column 220. The base plates 228 are positioned on opposing sides of the beam making up the vertical support column 220, and are transverse to the bottom plate 227. Beneficially, the base plates 228 serve to stiffen the bottom plate 227.

Figure 7A:
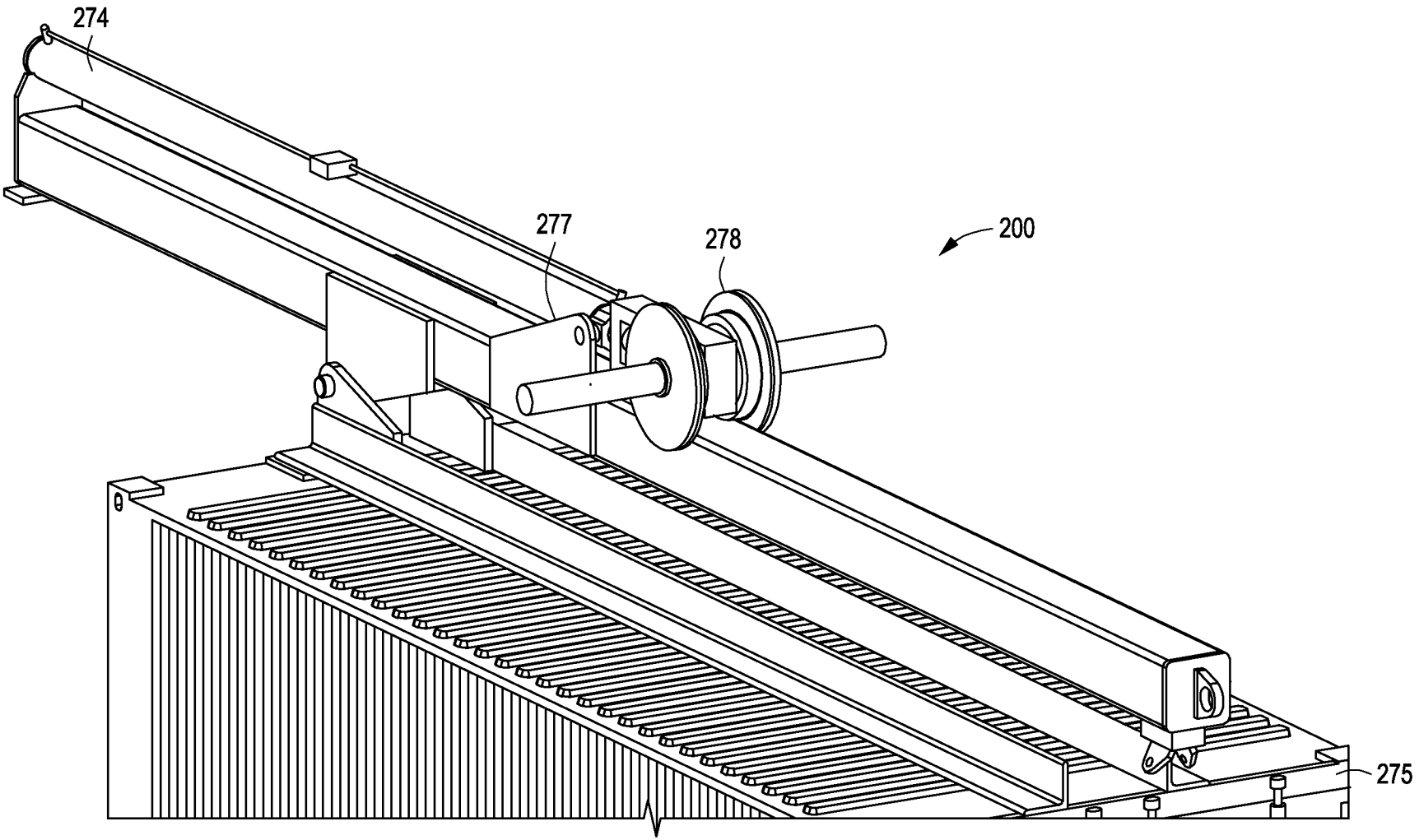
FIG. 7A is another perspective view of the rod pumping unit of the present invention, in one embodiment. Here, the vertical support column has been folded over onto the horizontal support base. This exposes the wellhead, allowing access to the wellbore by a workover crew.
Figure 7B:
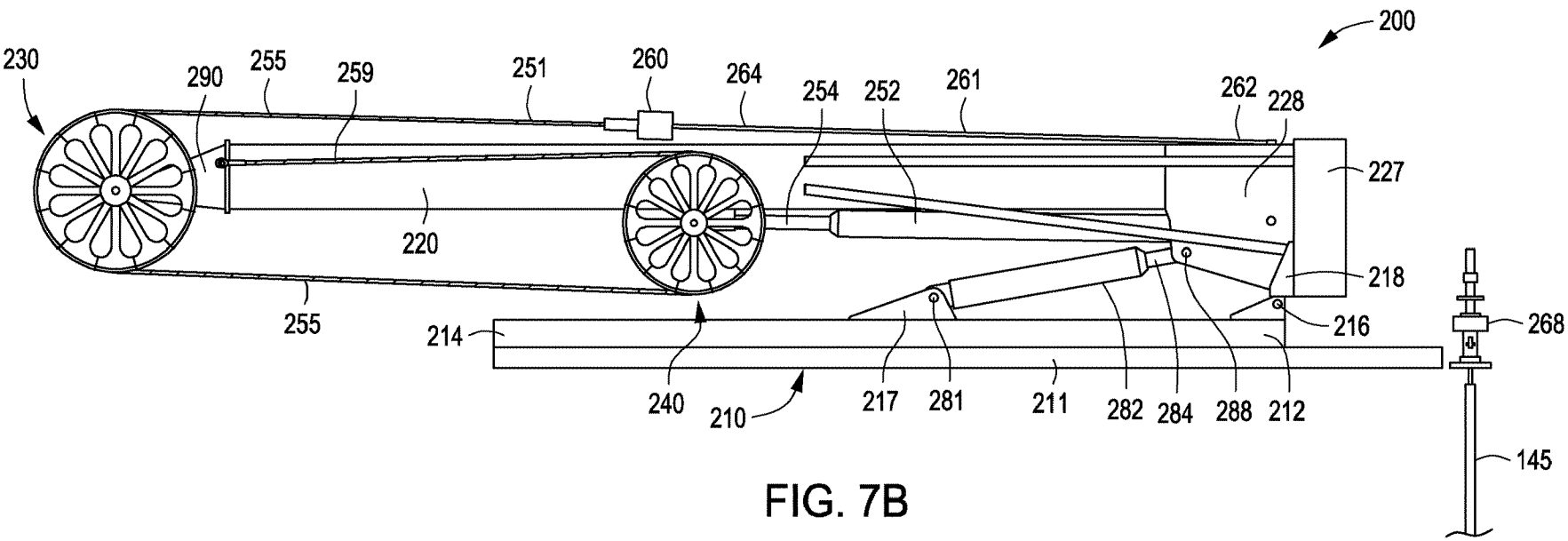
FIG. 7B is a side view of the rod pumping unit of FIG. 7A. A near-horizontal actuator is shown in a lowered (or retracted) position.
Figure 7C:
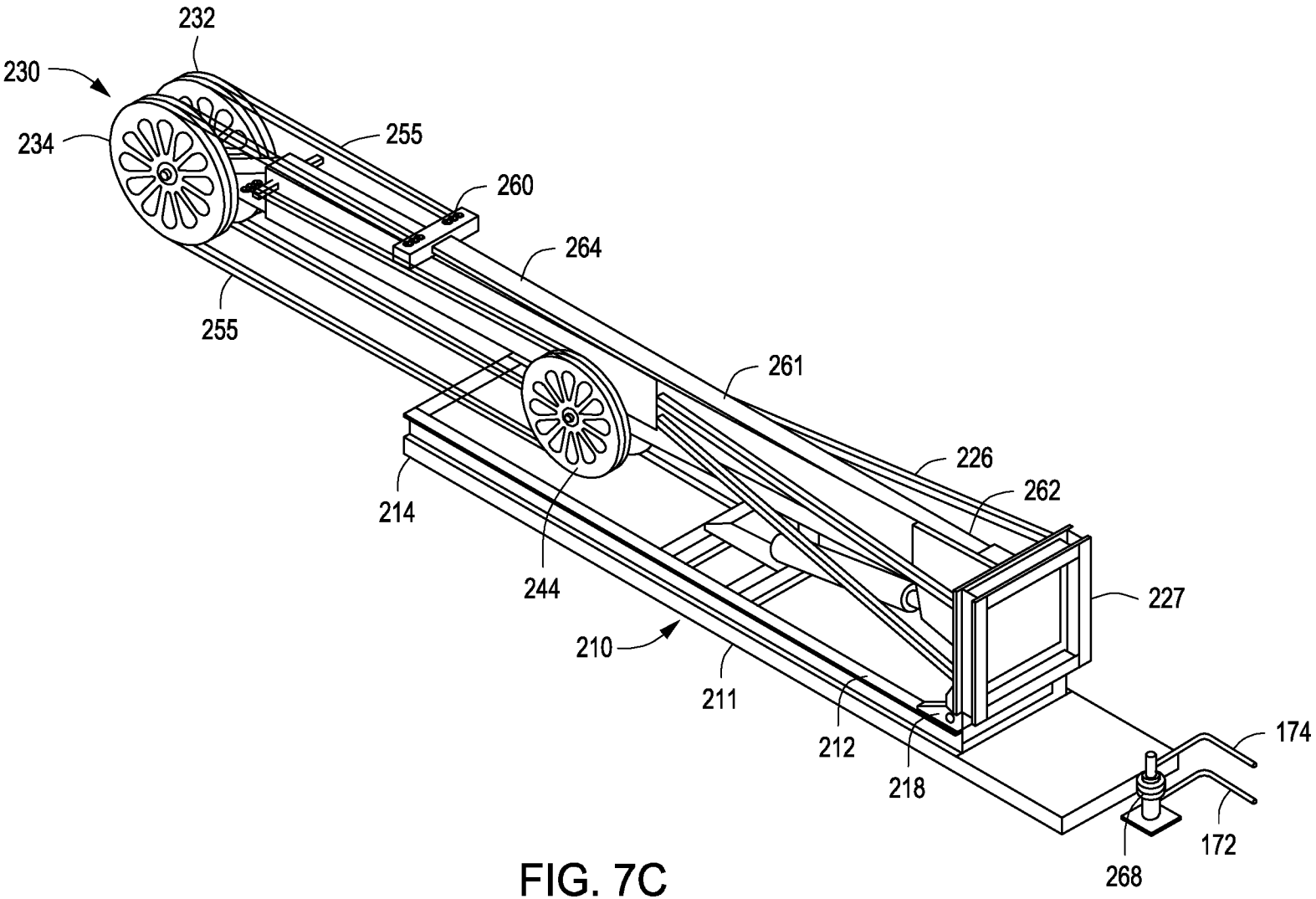
FIG. 7C is a perspective view of the rod pumping unit of FIG. 7A. A tension strap has been placed between the carrier bar and the base of the vertical support column, holding the carrier bar in place by tension.
Figure 8:
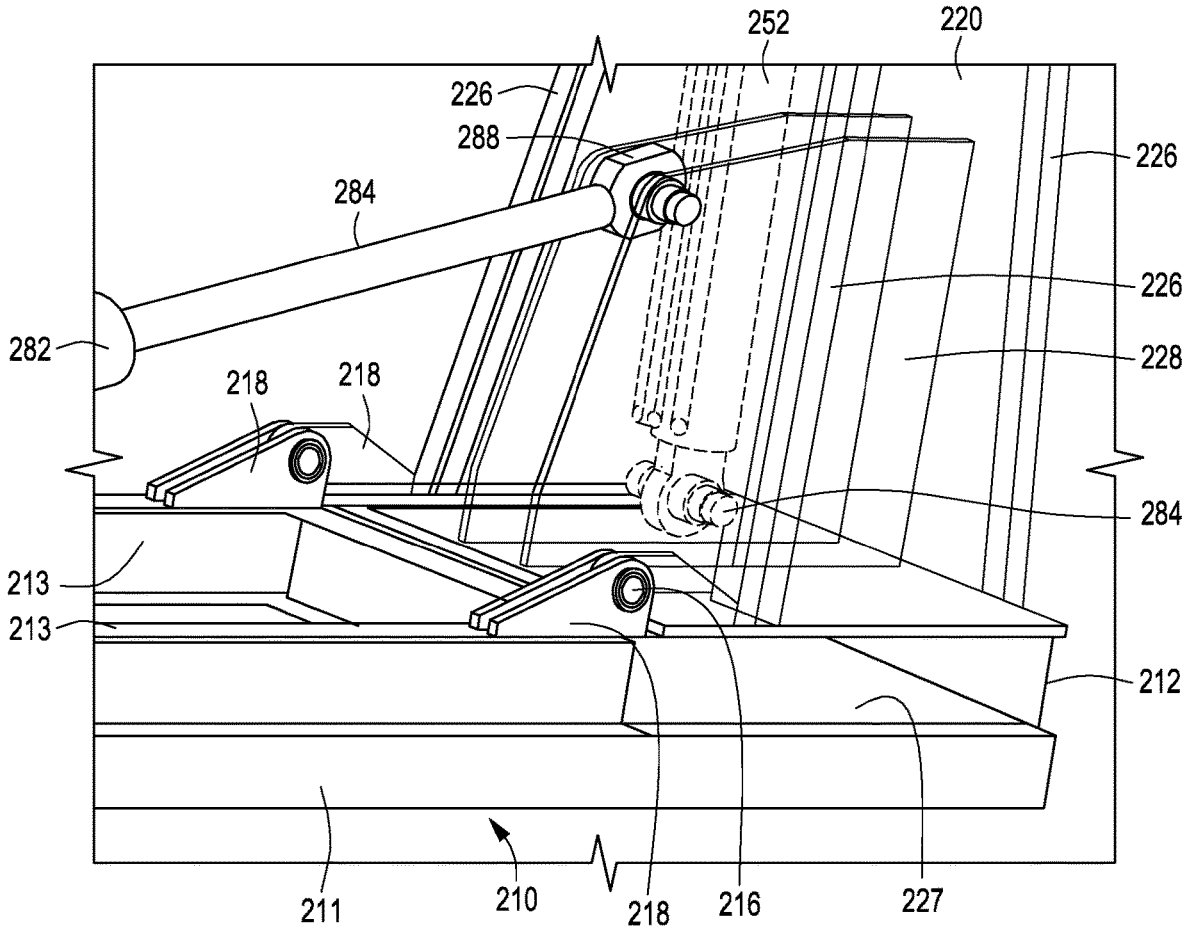
FIG. 8 is an enlarged, perspective view of the hinged connection between the horizontal support base and the vertical support column. In this view, the vertical support column is back in its raised position.

Of interest, the vertical support column 220 may be connected to the horizontal support base 210 by means of a pin 216. More specifically, a pair of pins 216 is used, as shown in FIG. 8. Of course, additional pins 216 may be used for stability. The pins 216 extend through aligned openings in the bottom plate 227 and the brackets 218. In this way, a hinged connection is formed. (Some may refer to this as a rod-eye clevis arrangement.) The hinged connection allows the vertical support column 220 to be folded over onto the horizontal support base 210. This position is shown in FIGS. 7A, 7B and 7C, and is described further below.

The rod pumping unit 200 also includes a crown 290. The crown 290 defines a metal plate (or plates) that extends up from the distal end 224 of the vertical support column 220. The crown is used to support an axle 235. In one arrangement, the axle 235 turns along a horizontal axis at the top of the crown 290. In a preferred embodiment, the axle 235 is held fixed while shaft bearings (not shown) rotate about the axle 235. Of course, an arrangement could be provided where the axle 235 turns within a fixed bearing housing.

The rod pumping unit 200 further includes a standing sheave 230. The standing sheave 230 defines a wheel having a central opening. The opening receives the axle 235. Preferably, the wheel making up the standing sheave 230 defines a metal plate, or a pair of metal plates, having a plurality of spokes 236. The spokes 236 are best seen in the perspective views of FIGS. 3E and 4A, discussed below.

In a preferred embodiment, the standing sheave 230 comprises a pair of wheels. These are indicated at 232 and 234 in FIG. 2C. The axle 235 extends through central openings in each of the wheels 232, 234. The wheels 232, 234 reside on opposing sides of the crown 290 and turn together.

The rod pumping unit 200 also includes a traveling sheave 240. The traveling sheave 240 also defines a wheel having a central opening. The opening receives an axle 245 and also includes shaft bearings. Preferably, the wheel making up the traveling sheave 240 also defines a metal plate, or a pair of metal plates, having a plurality of spokes 246. The spokes 246 are best seen in the perspective view of FIG. 4A, discussed below.

In a preferred embodiment, the traveling sheave 240 comprises a pair of wheels. These are indicated at 242 and 244 in FIG. 2C. The axle 245 extends through central openings in each of the wheels 242, 244. The wheels 242, 244 reside on opposing sides of the vertical support column 220 and turn together. Of interest, the wheels 242, 244 move along the back face 320 of the vertical support column 220, and are held in place by the force of wire ropes 255. More specifically, the wheels 242, 244 are held in place by the forces generated by the angles acting on the wire ropes 255 and their offset centerlines $CL_{SS}$, $CL_{TS}$.

As the names imply, the standing sheave 230 remains in a stationary position relative to the concrete pad 211 during operation of the rod pumping unit 200. The only motion is the rotational movement of the wheels 232, 234 about (or with) the axle 235. At the same time, support rollers associated with the traveling sheave 240 roll up and down relative to the concrete pad 211. As will be explained, vertical movement of the wheels 242, 244 making up the traveling sheave 240 cause a polished rod 265 to reciprocate up and down along the front face 310 of the vertical support column 220.

To help support the vertical support column 220 relative to the concrete pad 211, a collection of axial support rods 226 (or stiff-legs) is provided. In the arrangement of FIGS. 2A, 2B and 2C, four separate axial support rods 226 are used. The support rods 226 may be welded or bolted at one end to the bottom plate 227, and at the other end to sides of the vertical support column 220.

The axial support rods 226 add rigidity to the support column 220 and spread the supporting load to a wider portion of the bottom plate 227. As shown in FIG. 7A, the support rods 226 move with the vertical support column 220 when it is folded over on top of the horizontal support base 210.

The various items of hardware described above, including the crown 290, the vertical support column 220, and the support rods 226 may be pre-welded together, or may be of a modular construction. In the latter instance, components of the rod pumping unit 200 may be assembled at the well site, after transport. The present inventions are not limited by how the rod pumping unit 200 is assembled or disassembled unless so stated in the claims.

The rod pumping unit 200 also includes a linear actuator 250. The linear actuator 250 resides along the back face 320 of the vertical support column 220 in a vertical orientation. The linear actuator 250 has a proximal end 252 that is anchored (or otherwise operatively connected to) to the bottom plate 227. Preferably, the proximal end 252 defines a hydraulic barrel that is pinned to the bottom plate 227. In a preferred embodiment, the linear actuator 250 is positioned to have a nearly parallel mounting orientation to the support column with a slight angle biased into the support column 220, perhaps being a one- to four-degree lean into the vertical support column 220. This helps provide stability to the linear actuator 250 as it pushes the traveling sheave 240 up the back face 320 of the vertical support column 220.

The linear actuator 250 also includes a distal end 254. The distal end 254 preferably defines a telescoping piston rod that moves in and out of the barrel 252. The piston rod 254 is pinned to the axle 245 of the traveling sheave 240. The pinned connection is further described below in connection with FIG. 4C. A suitable example of a hydraulic assembly for the linear actuator 250 is the Hanna MT Mill-type cylinder available from Hanna Cylinders of Pleasant Prairie, Wisconsin.

In one aspect, the barrel 252 of the linear actuator 250 is between 20 and 40 feet in length, while the piston rod 254 is between 20 and 50 feet in length. These dimensions are a matter of designer's choice, depending on the ultimate length of the polished rod 265 used and ultimately the desired pump displacement downhole.

In operation, the piston rod 254 moves in and out of the barrel 252 cyclically. This cyclical movement of the piston rod 254 (and connected traveling sheave 240) is imparted in response to a volume of pressurized hydraulic fluid that is forced into or allowed to be released from the barrel 252 by a hydraulic pump (shown at 340 in FIG. 9A and at 950 in FIGS. 9B and 9C). Alternatively, the linear actuator 250 may be driven by a linear electric motor or an electrical screw drive or a roller drive. In this instance, the near-vertical linear actuator comprises a mechanical linear actuator which takes in rotary motion and outputs linear motion, with the near-vertical linear actuator having a first end fixed relative to the horizontal support base, and a second end affixed to the traveling sheave. In the latter instance, cyclical movement of the traveling sheave is imparted by cyclical movement of the rotary input provided by an electric motor. This may include the use of a motor having a stator and magnetic field. Thus, the term "vertical linear actuator" is not limited to a hydraulic barrel and piston.

The rod pumping unit 200 is operated through a master control panel 400. The control panel 400 includes a control box 450. The control box 450 houses electronics such as a master controller 410, manual on-off switches 420 and a back-up battery 430. The control box 450 is optionally supported by a support pole 455. The support pole 455 is secured to a cement pad (not shown) or is otherwise cemented into position proximate to the rod pumping unit 200. As an alternate arrangement, the support pole 455 may be mounted onto or otherwise secured to a counter-weight powerhouse module (seen at 275).

Figure 9A:
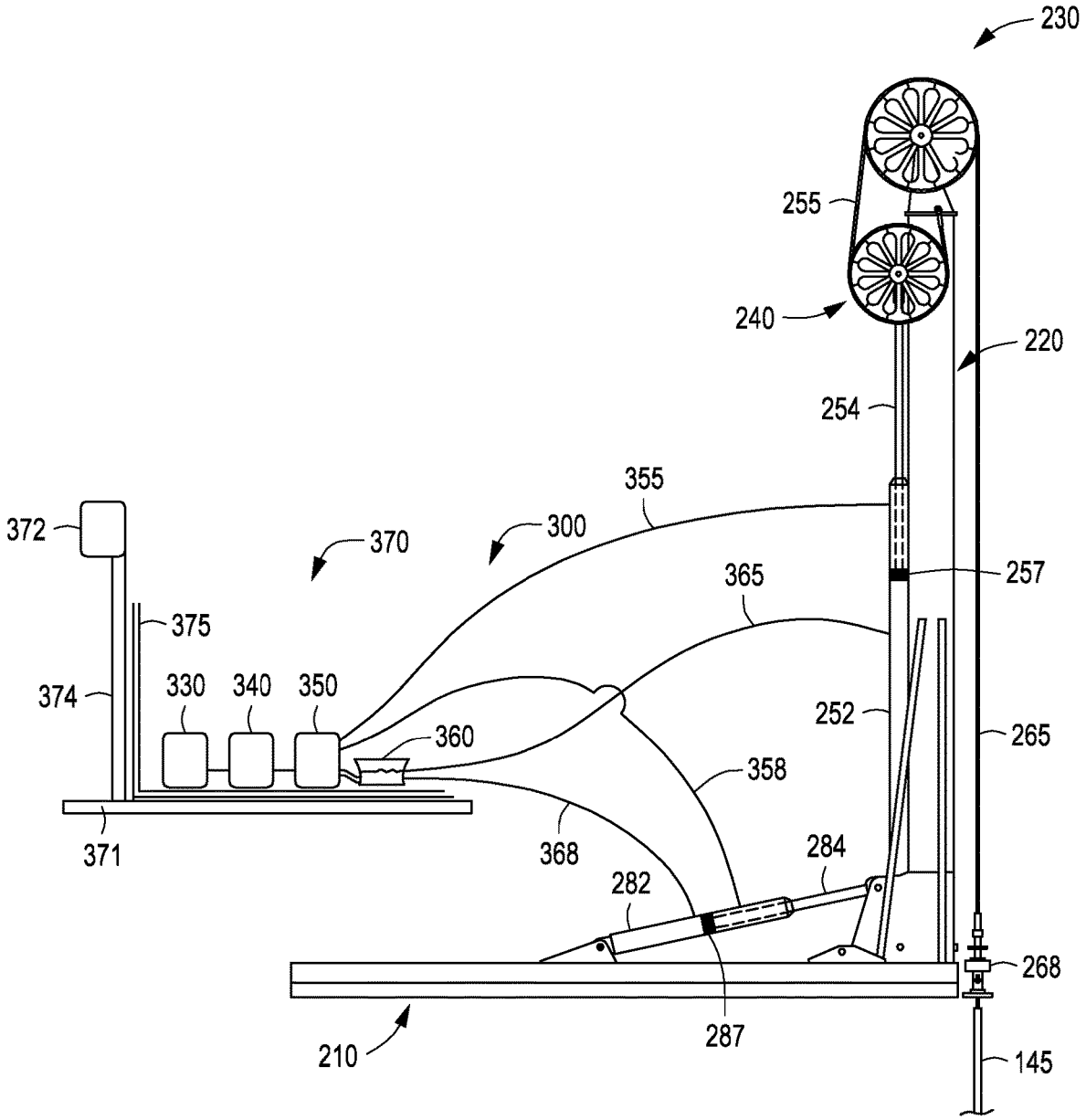
FIG. 9A is a schematic view of a hydraulic fluid pumping system as may be used with the rod pumping unit of the present invention, in a first embodiment. In this arrangement, an open loop system is used to move the vertical linear actuator.
Figure 9B:
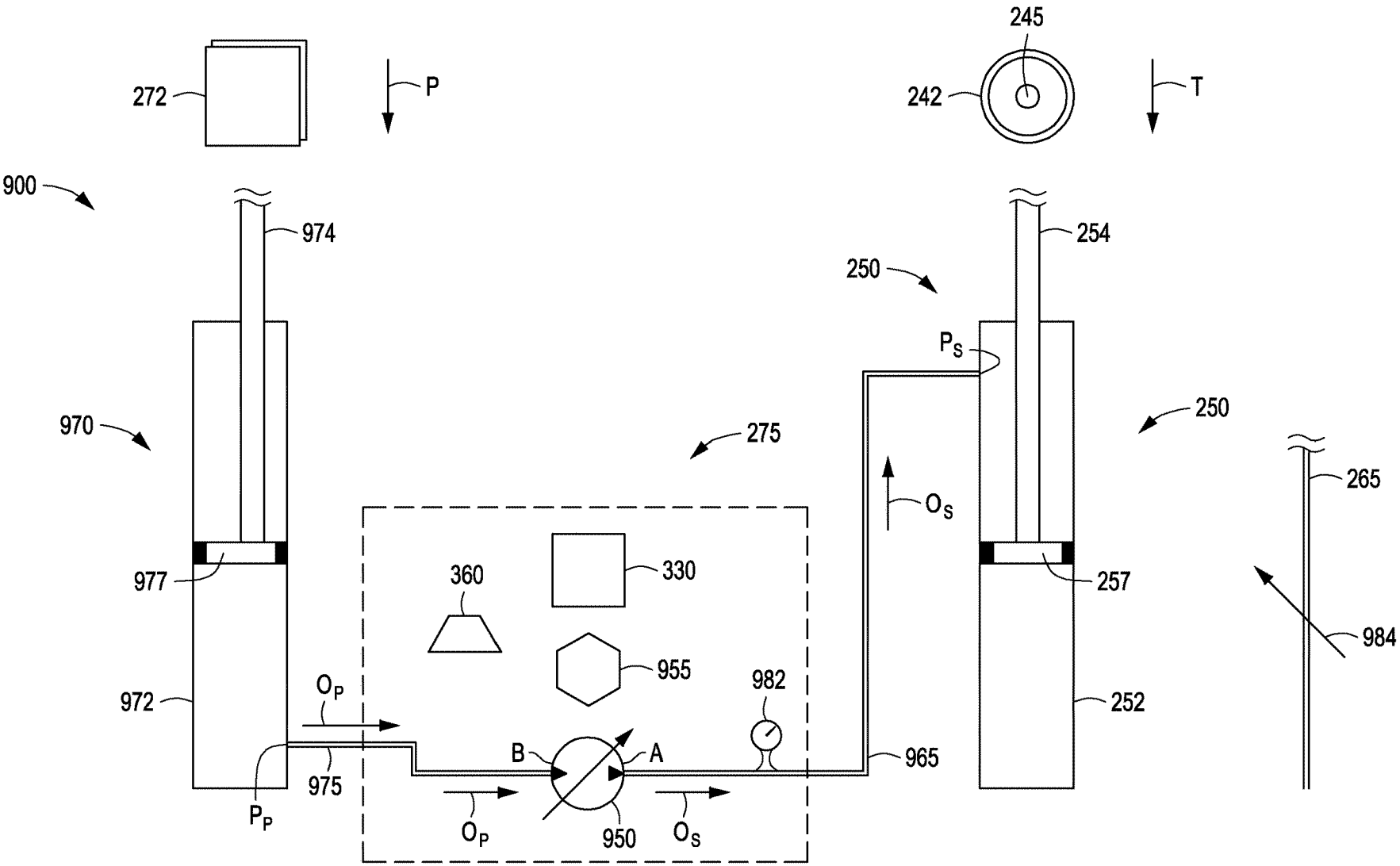
FIG. 9B is a schematic view of a hydraulic fluid pumping system as may be used with the rod pumping unit of the present invention, in a second embodiment. In this arrangement, a closed loop system is used to move the vertical linear actuator. In this view, the counter-weight plates are being lowered while the traveling sheaves are also being lowered. This has the effect of raising the polished rod.
Figure 9C:
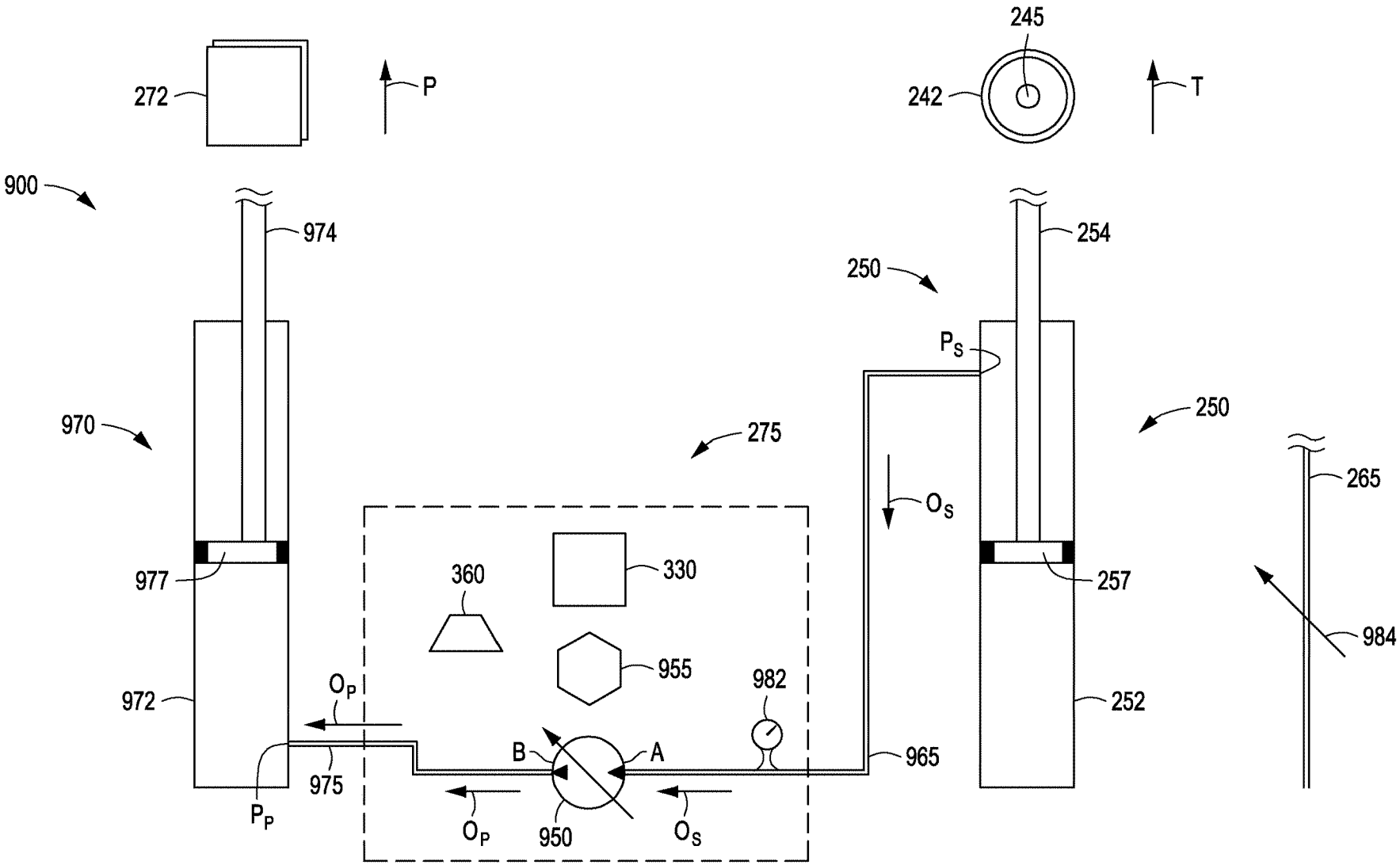
FIG. 9C is another schematic view of the hydraulic fluid pumping system of FIG. 9B. Here, the counter-weight plates are being raised while the traveling sheaves are also being raised. This has the effect of lowering the polished rod.

The controller 410 regulates the energy flow of rotational torque thru the prime mover 330 into and out of the hydraulic pump (shown at 950 in FIGS. 9B and 9C). The hydraulic pump 950, in turn, controls the cyclical movement of the near-vertical linear actuator 250. The prime mover 330 is preferably an electric motor that provides rotational torque to the pump 950. The controller 410 also controls the switching of positions of a master fluid valve 955, directing hydraulic fluid within the closed loop connections. In one aspect, the pump 950 is able to control fluid flow direction through left-hand (or Side A) and right-hand (Side B) side ports of the pump (shown at 950 in FIGS. 9B and 9C).

The controller 410 may monitor the input voltage supply to detect low-voltage events indicative of a brown-out. The controller 410 also regulates the hydraulic pump volumetric displacement (flow volume setting) as well as limiting minimum and maximum allowable working pressures on both sides of the hydraulic pump 340 working ports A and B. Beneficially, the controller 410 also acts as the rod pump "pump off controller" by detecting, storing and averaging actual weight transfer position. The controller 410 further detects, stores, and averages data related to changes in position and rates of change of weight transfer which occur during the rod pumping process.

The controller 410 may interface and use an existing off-the-shelf pump-off controller in producing downhole dynamometer cards. Such controllers are available from Delta Electronics, Inc. of Taipei City Taiwan (sold domestically through Delta Americas); Redhead Artificial Lift Ltd. of Lloydmaster, Canada; Petrolog Automation, Inc. of San Antonio, Texas; Weatherford Technology Holdings, LLC; and several others.

The controller 410 includes circuitry (not shown) that resides within a sealed housing for implementing a control algorithm. The algorithm varies the pump cycle rate of the downhole positive displacement pump located at the moving end of the polished rod string 132 in response to the amount of fluid produced from the pump and the position of the master fluid valve. In one aspect, the controller 410 increases the pumping cycle speed of strokes-per-minute in user-defined steps. For example, if a pump appears to have low pump fillage on a previous downstroke or average of previous downstrokes (as measured by the load cell or a hydraulic fluid pressure transducer, and polished rod position), described as weight transfer position, then a signal will be generated to either not lift the polished rod as far on the proceeding pump cycle or average of pump cycles, or to decrease pump speed (pump cycles per minute) or dwelling at the top of the next pump intake stroke in any combination. This allows additional time to fill the downhole pump during its intake stroke. This decrease in pump speed reduces the pump output, which in turn should increase the pump fillage percentage of volume as it provides both additional time for the well annulus to fill the downhole pump or by decreasing the downhole pump's effective cubic inch displacement per running minute.

When a decrease in speed does not produce a proportional increase in pump fillage, the rod pump controller is able to decrease the total travel distance that the traveling valve and plunger are lifted. This causes a decrease in volumetric pump displacement at the bottom of the well and adds time in the pump intake stroke by dwelling at the top of the pump intake stroke. The controller 410 may iteratively slow the upstroke speed until the desired pump fillage is achieved. Reciprocally, if a pump appears to have complete pump fillage on a downstroke (as measured by the load cell or other means) by detecting weight transfer position, then a signal may be generated to increase pump speed. This enables the pumping system 200 to capture more wellbore fluids each stroke.

The controller 410 continually evaluates the pump fillage, generating speed increase/decrease signals, total linear travel distance/volumetric pump displacement per pump stroke and time dwell increased or decreased at the top of each pump intake stroke movement as needed to keep the pump fillage within desired set-points.

Preferably, the controller 410 is capable of starting and stopping the movement of the traveling sheave 240 at any point of travel along the vertical support column 220. The controller 410 may also hold the movement of the traveling sheave 240 by stopping movement of the linear vertical actuator 250 in place. Preferably, the controller 410 is further capable of regulating maximum velocity and motion profiles of movement including acceleration and deceleration in both directions and limiting the minimum and maximum amount of force generated by the vertical linear actuator 250. Further, the controller 410 can hold the traveling sheave 240 at any given position while supporting the instantaneous load. In one aspect, this can be done using a remote control device that sends signals to the controller 410 through wireless signals.

In another aspect, this may be done autonomously such as when detecting pump fillage or when testing for traveling valve assembly leakage or standing valve leakage. Traveling valve assembly leakage testing includes the autonomous stopping and holding of the polished rod 265 during an upstroke. Alternatively, traveling valve assembly leakage testing may include the autonomous determination of a rate of change in the polished rod load, or the autonomous determination of a traveling valve leakage factor. Standing valve leakage testing includes the autonomous stopping and holding of the polished rod during a down stroke after weight transfer, the autonomous determination of a rate of change in the polished rod load, and the autonomous determination of a standing valve leakage factor. U.S. Pat. No. 8,844,626 describes a controlled system for the autonomous stopping and holding of the polished rod 265. The '626 patent is incorporated herein in its entirety.

Because wheels 242, 244 are used to move the polished rod 265, the controller 410 can effectuate accelerating and decelerating of the traveling sheave 240 speed in a smooth manner. Through the knowledge of weight transfer position, rate of change during weight transfer position in the downhole pump, knowledge of current pump cycle and of previous pump cycles, the controller 410 is able to optimize pump performance. This optimization can occur in various ways such as by lifting the polished rod string assembly and fluid column load only as far as required as compared to liquid fillage volume and gas compression travel of the downhole pump. Having the ability to vary the bottom of stroke turn around position can increase or decrease pump compression ratio. Stopping and dwelling at the top of the stroke for a brief instance allows additional downhole pump fillage across the standing valve.

Reciprocally, the controller 410 can slow the speed of the downhole pump as the polished rod 265 reaches the point of previous weight transfer position. This allows weight transfer to occur with reduced fluid pound. As an additional feature of the rod pumping unit 200 and its controller 410, energy regeneration can be acquired during the downstroke. This is provided by spinning an electric motor shaft residing within the counter-weight powerhouse module 275. The electric motor shaft is spun faster than its synchronous speed, thereby generating electrical energy during the downstroke of the polished rod 265.

It is again observed that the pumping system 200 is biased in the downstroke position. When the counterweight powerhouse module 275 is used, the electrical energy may optionally be generated from the falling polished rod string and fluid weight by virtue of the pressurized fluid stream passing through the main pump (seen at 950 in FIG. 9B). In this instance, less torque is placed on the electric motor 330.

Returning to FIGS. 2A through 2C, the rod pumping unit 200 also includes a carrier bar 260. The carrier bar 260 is configured to be attached to the polished rod 265 along the front face 310 of the vertical support column 220. This may be done, for example, through the use of known polished rod clamps. The carrier bar 260 lifts the polished rod 265 up and down through a stuffing box 268 in response to movement of the traveling sheave 240.

As noted above, the rod pumping unit 200 also includes a plurality of wire ropes 255. Each wire rope 255 has a proximal end 251 and a distal end 259. The proximal end 251 is secured to the carrier bar 260. This is best seen in FIG.

Figures 1, 2D:
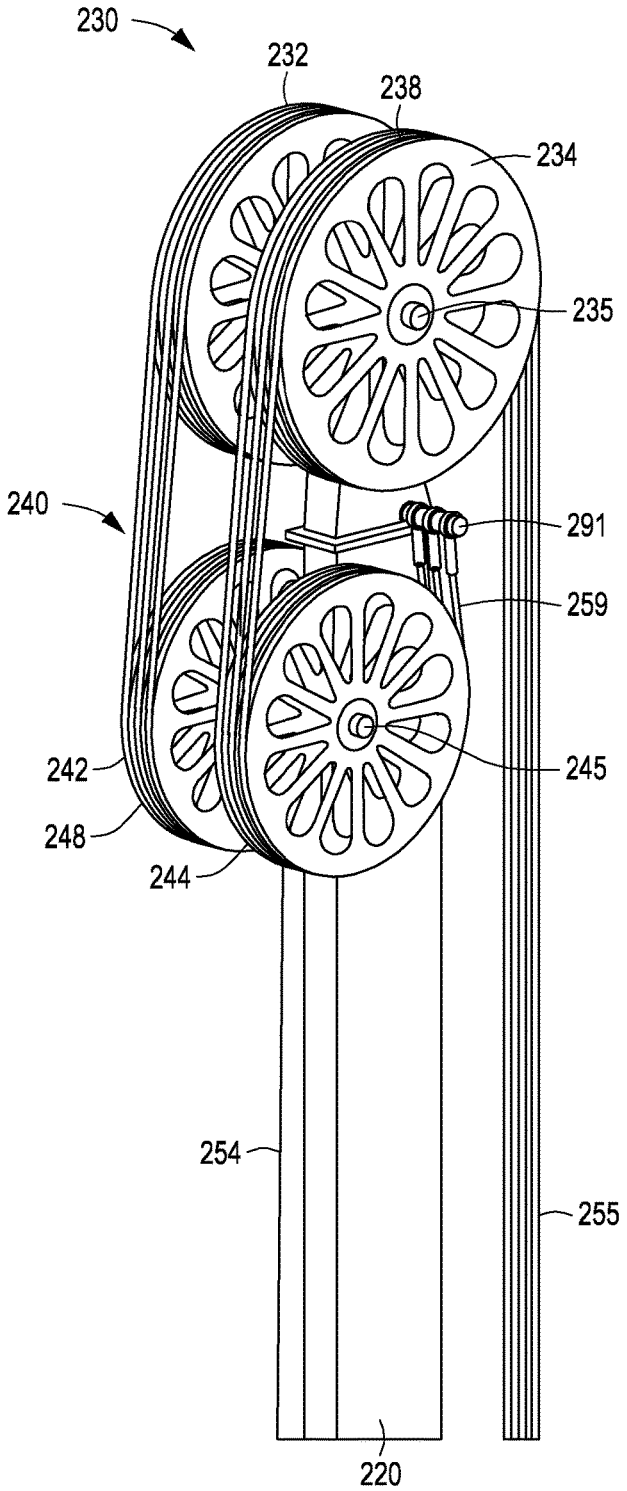
Figures 2, 2D:
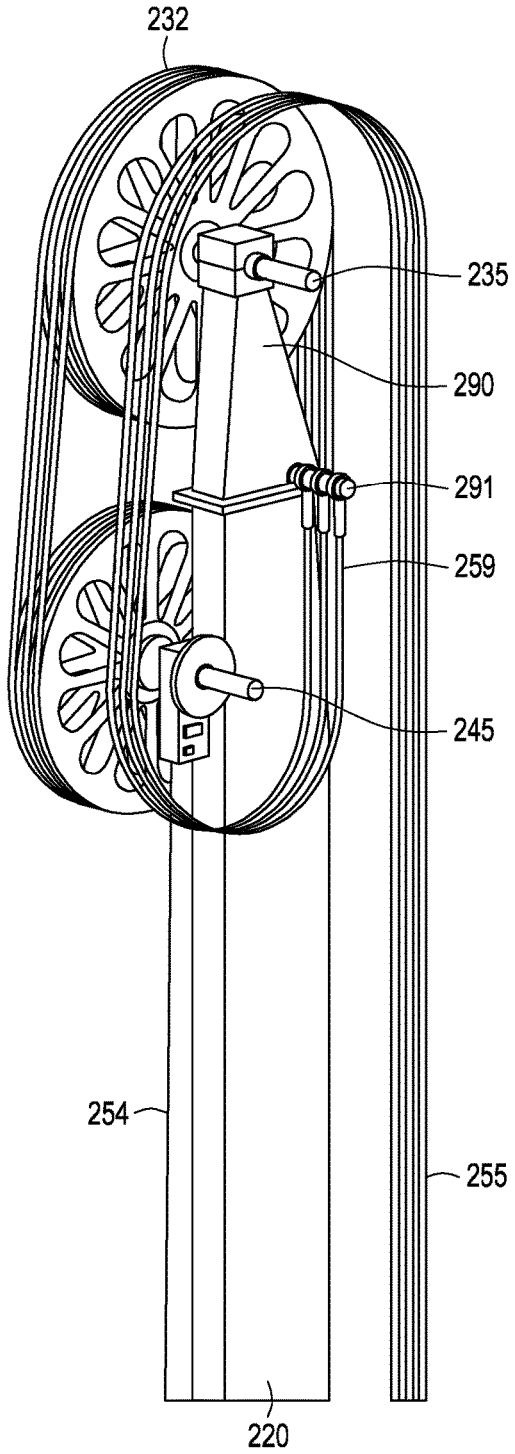

5. At the same time, the distal end 259 is pinned to the crown 290. This is best seen in FIGS. 2D-2 and FIG. 3E.

Each wire rope 255 is wound over the standing sheave 230 and under the traveling sheave 340. In a preferred arrangement, the standing sheave 230 comprises a pair of wheels 232, 234, while the traveling sheave 240 also comprises a pair of wheels 242, 244. Each wheel 232, 234 has grooves 238 for receiving a respective wire rope 255. Similarly, each wheel 242, 244 has grooves 248 for receiving a respective wire rope 255.

Preferably, the standing sheave 230 has three separate grooves 238 for receiving three respective wire ropes 255. At the same time, and preferably, the traveling sheave 240 has three separate grooves 238 for receiving three respective wire ropes 255. Of interest, because of the weight of the carrier bar 260, polished rod 265 and supported rod string 132 and fluid load, the wire ropes 255 remain in tension at all times. Of even greater interest, the piston rod 254 of the vertical linear actuator 250 remains in tension at all times as it supports the carrier bar 260, the polished rod 265, the rod string 132 and the wellbore fluid load (together, the "polished rod string assembly").

The pair of traveling sheaves 242, 244 produces a 2:1 wire rope and sheave mechanical advantage arrangement. The mechanical advantage is provided through the tension force used while lifting the polished rod string assembly. This may be referred to as a "travel amplifier." By having one end 259 of the multiple ropes 255 anchored to the support column 220, the proximal end 251 of the multiple ropes 255 all move twice the distance. Thus, one foot of mechanism travel produces two feet of wire rope travel, which translates to two feet of polished rod travel.

Figure 1:
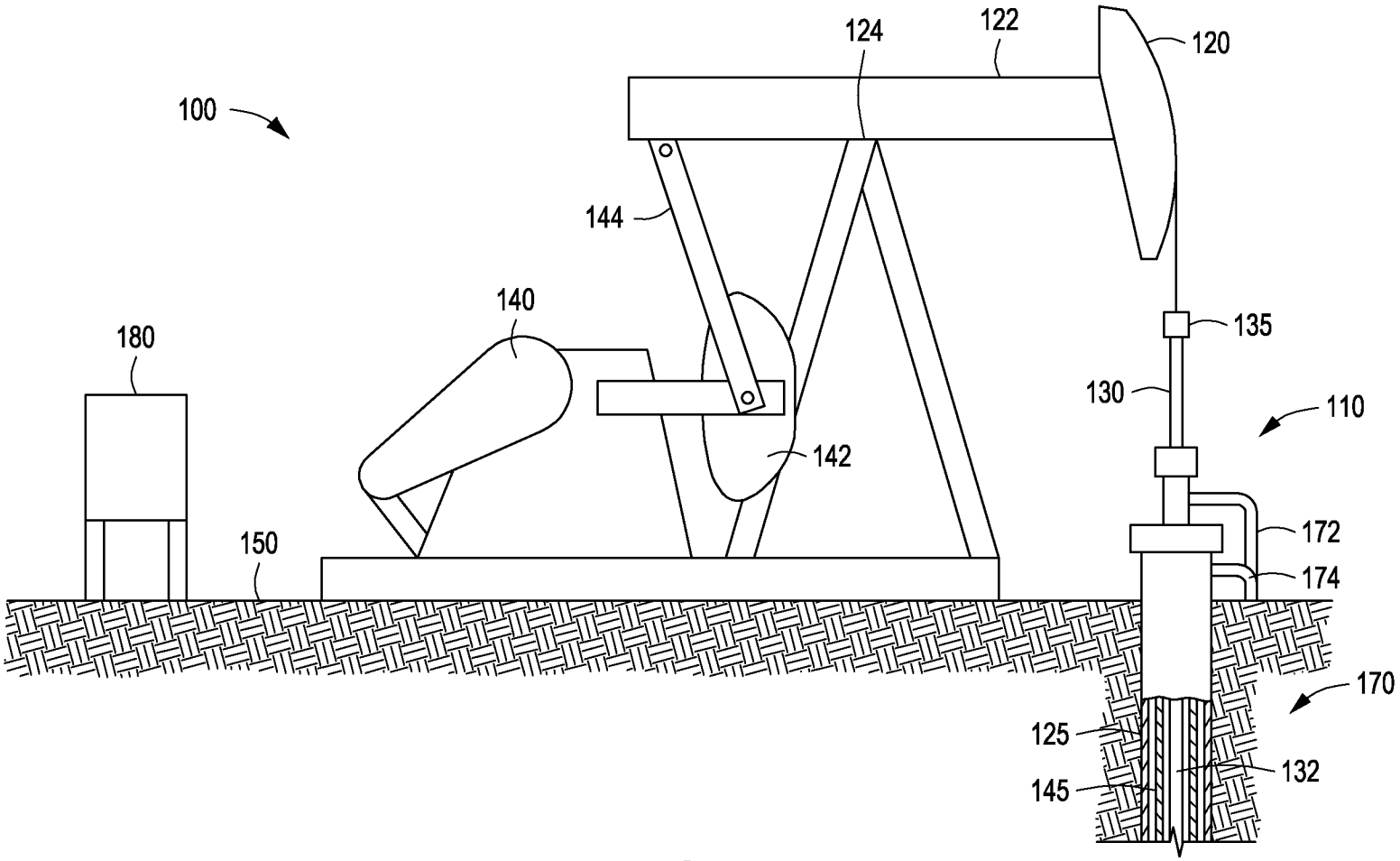
FIG. 1 (Prior Art)
FIG. 1 is a schematic, side view of a known rod pumping unit. This is a so-called rocking horse pumping unit, or "pump jack."

FIG. 2D-1 is an enlarged, perspective view of the standing sheave 230 and the traveling sheave 240 of FIG. 2A. It can be seen that six wire ropes 255 are wound over the wheels 232, 242, 234, 244. The ropes 255 are pinned at their distal ends 259 using pin 291. (It is understood that pin 291 receives three wire ropes 255 on one side of the crown 290, and then three ropes 255 on the opposing side of the crown 290.) Pin 291 may actually be two separate pins extending out of opposing sides of the crown 290.

In a preferred arrangement, each of the wire ropes 255 is identical in length and in construction. Each wire rope 255 may be fabricated from small wires woven into strands, which are then woven into a single rope. The individual wires may be of lower tensile strength, giving them better flexibility. The wire ropes 255 may optionally be pre-stretched before operation of the rod pumping unit 200.

FIG. 2D-2 is another enlarged, perspective view of the standing sheave 230 and the traveling sheave 240 of FIG. 2A. Here, wheel 234 of the standing sheave 230 and wheel 244 of the traveling sheave 240 have been removed for illustrative purposes. Of interest, a portion of axles 235 and 245 are visible due to removal of the wheels 234, 244. In a preferred embodiment, the axles 235, 245 are fixed, or stationary, while the wheels 232, 234, 242, 244 rotate about the axles 235, 245 using bearing housings.

Figure 2E:
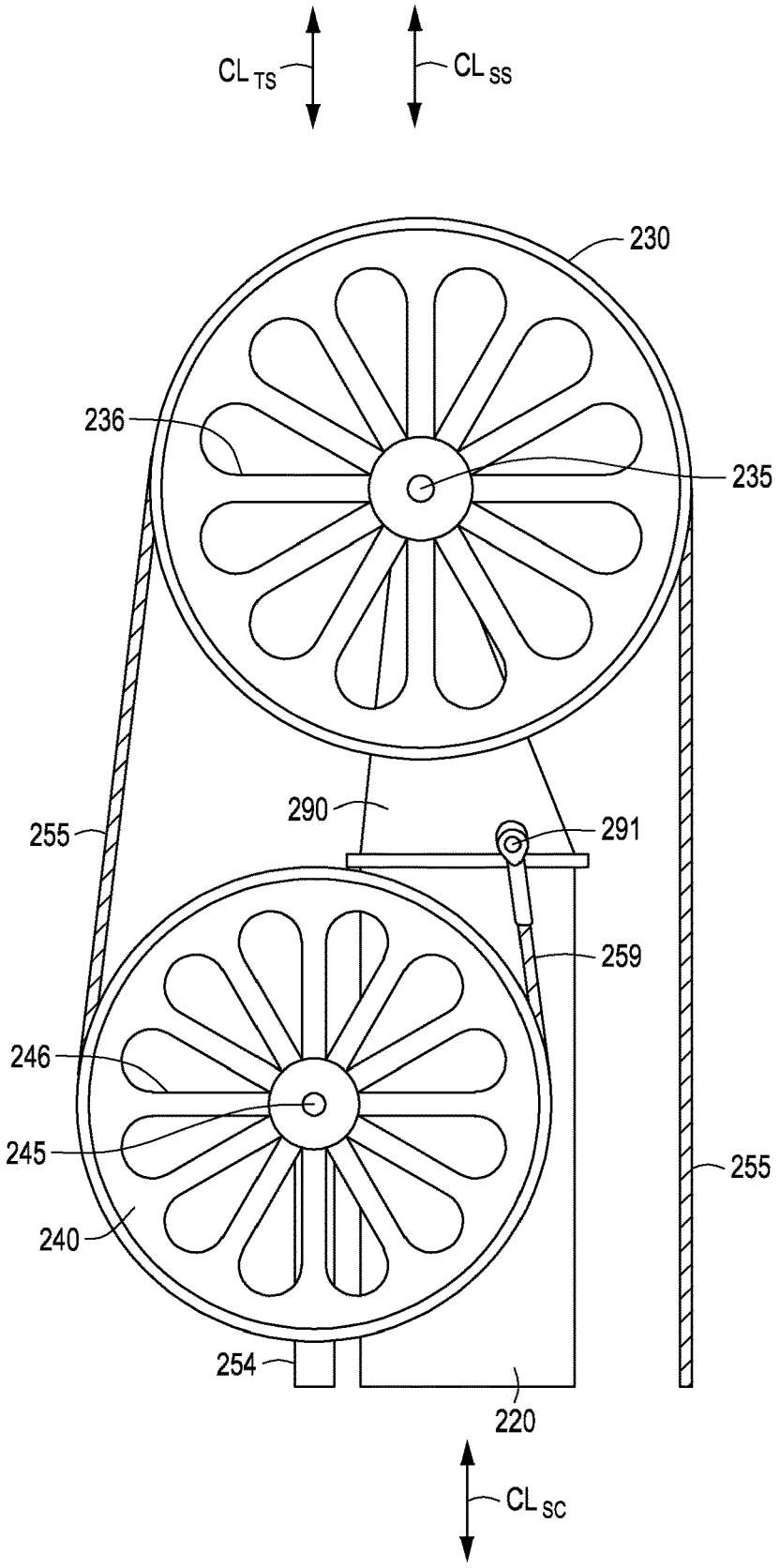
FIG. 2E is an enlarged, side view of the upper portion of the rod pumping unit of FIG. 2B. The standing sheave and the traveling sheave are shown more clearly. Vertical center-lines for the standing sheave, the traveling sheave and the vertical support column are also indicated.

FIG. 2E is an enlarged, side view of the rod pumping unit 200 of FIG. 2B. The standing sheave 230 and the traveling sheave 240 are shown more clearly. A vertical center-line $CL_{SS}$ is shown for the standing sheave 230. Similarly, a vertical center-line $CL_{TS}$ is shown for the traveling sheave 240. Finally, a vertical center-line $CL_{SC}$ is shown for the vertical support column 220. Note that each of these center-lines $CL_{SS}$, $CL_{TS}$, $CL_{SC}$ is offset from the other. The degree of offset is a matter of designer's choice, but is primarily dictated by mechanical stability (or load balancing) of the rod pumping unit 200.

It is also observed that the polished rod 265 reciprocates vertically, through the stuffing box 268. The vertical line of movement of the polished rod 265 is also offset from the center-lines $CL_{SS}$, $CL_{TS}$, $CL_{SC}$.

In a preferred arrangement, each of the wheels 232, 234 making up the standing sheave 230 has a radius that is larger than a radius of each of the wheels 242, 244 making up the traveling sheave 240. The radii are tuned to create a relative angle between the wire ropes 255 and the center-line $CL_{SC}$ of the vertical support column 220. In the view of FIG. 2E, the traveling sheave 240 is in its raised position. In this position, the relative angle of the wire ropes 255 is about 6.6 degrees.

Figure 6A:
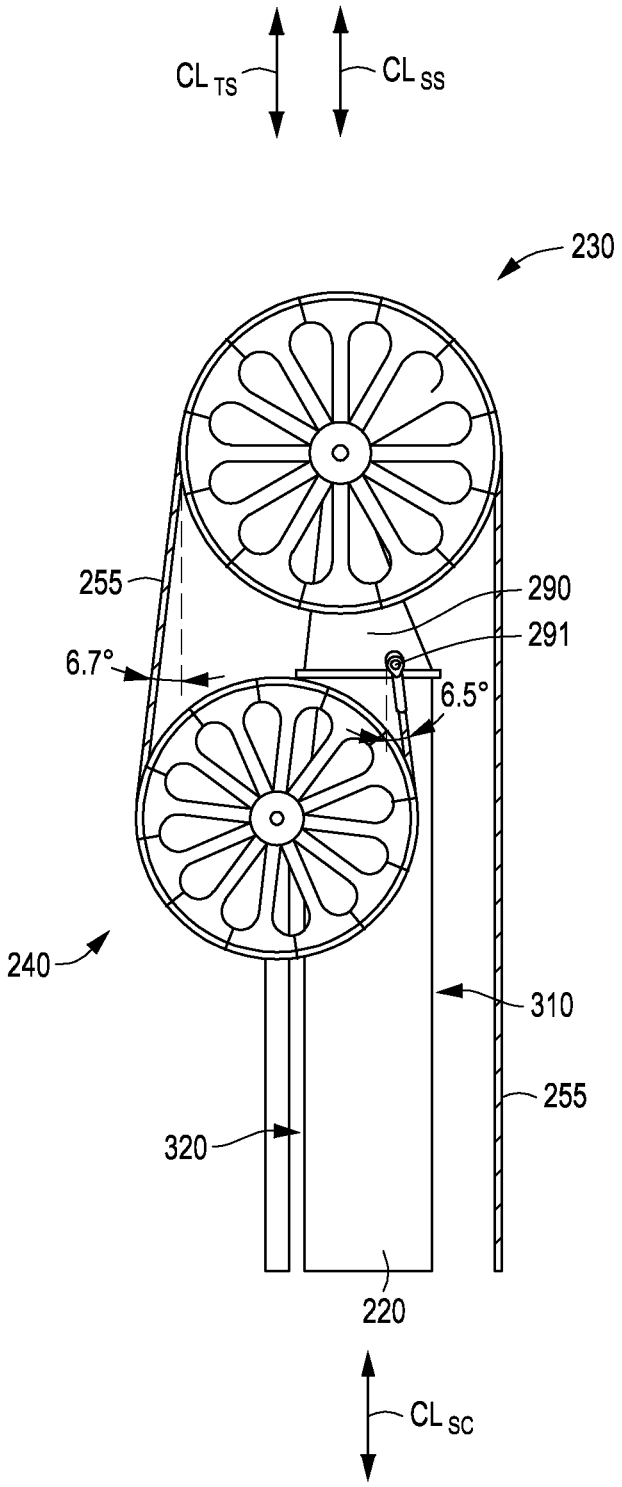
FIG. 6A is an illustrative side view of a portion of the rod pumping unit of FIG. 2E. The traveling sheave is in its raised position. Relative angles of the wire ropes along each side of the traveling sheave are presented.

FIG. 6A is an illustrative side view of a portion of the rod pumping unit 200 of FIG. 2E. Relative angles of the wire ropes 255 along each side of the traveling sheave 240 are presented. On the front face 310 of the vertical support column 220, the relative angle is shown at about 6.5 degrees. Similarly, on the back side 320 of the vertical support column 220, the relative angle is shown at about 6.7 degrees.

Keeping these two angles at essentially the same value provides load balancing along the vertical support column 220 $CL_{SC}$. This, in turn, minimizes the side load exerted into the support column 220 while the traveling sheave wheels 242, 244 move through their range of motion from top to bottom, and back up.

In operation, the cyclical movement of the linear actuator 250 causes the traveling sheave 240 to reciprocate up and down along the vertical support column 220. An upward movement of the wheels 242, 244 of the traveling sheave 240 produces a downstroke of the polished rod 265, while a downward movement of the wheels 242, 244 of the traveling sheave 240 produces an upstroke of the polished rod 265. The radius of the wheels 242, 244 and the location of the pins 291 along the crown 290 are design features that provide side load balancing during operation of the rod pumping unit 200.

A key to minimizing the side load exerted into the vertical support column 220 while the wheels 242, 244 of the traveling sheave 240 move throughout their range of motion from top to bottom of total distance traveled is the unique placement and balanced angles of wire rope entrance and departure to the traveling sheave pair. In addition, the location of the anchor pivot point 291 is tuned in relation to the two sheave pairs of different centerlines $CL_{SS}$, $CL_{TS}$ and outside diameters during operation.

In one aspect:

each rope 255 has a first angle of deviation defined by the angle of the rope 255 as it approaches the traveling sheave 240 relative to the center-line $CL_{SC}$ of the vertical support column 220;

each rope 255 also has a second angle of deviation defined by the angle of the rope 255 as it exits the traveling sheave 240 relative to the center-line $CL_{SC}$ of the vertical support column 220; and the angles of deviation for the two ropes are within 10 degrees of each other, and more preferably within 2 degrees of each other, at all times.

Thus, in FIG. 6A the first angle (6.7°) is within 2 degrees of the second angle (6.5°). Similarly, in FIG. 6B the first angle (2.1°) is within 2 degrees of the second angle (1.0°). This is true regardless of the position of the traveling sheave 240 along the vertical support column 220.

It is noted that during vertical motion of the traveling sheave wheels 242, 244, the wire rope 255 entrance and departure angles vary, but at the same time remain nearly equal—equal but opposite to each other—to provide the desired load balancing. Because the angles are near-equivalent, the resultant force differential caused from the offset rotating center-lines $CL_{SS}$, $CL_{TS}$, and different outside diameters of the stationary sheave wheels 232, 234 versus the traveling sheave wheels 242, 244 in relation to the center-line of the support column $CL_{SC}$ is controlled. This load balancing is effectuated even though the lifting loads imposed on the wire ropes 255 are extremely high.

Because of the wire rope working angles and free rope operating distances between both sheave pair sets, the resulting side load force transferred into the support column 220 also varies and is directly correlated to the traveling sheave pair operating position. The greatest net effective side load force (least balanced) is with the traveling sheave wheels 242, 244 in their lowest position.

Figure 3A:
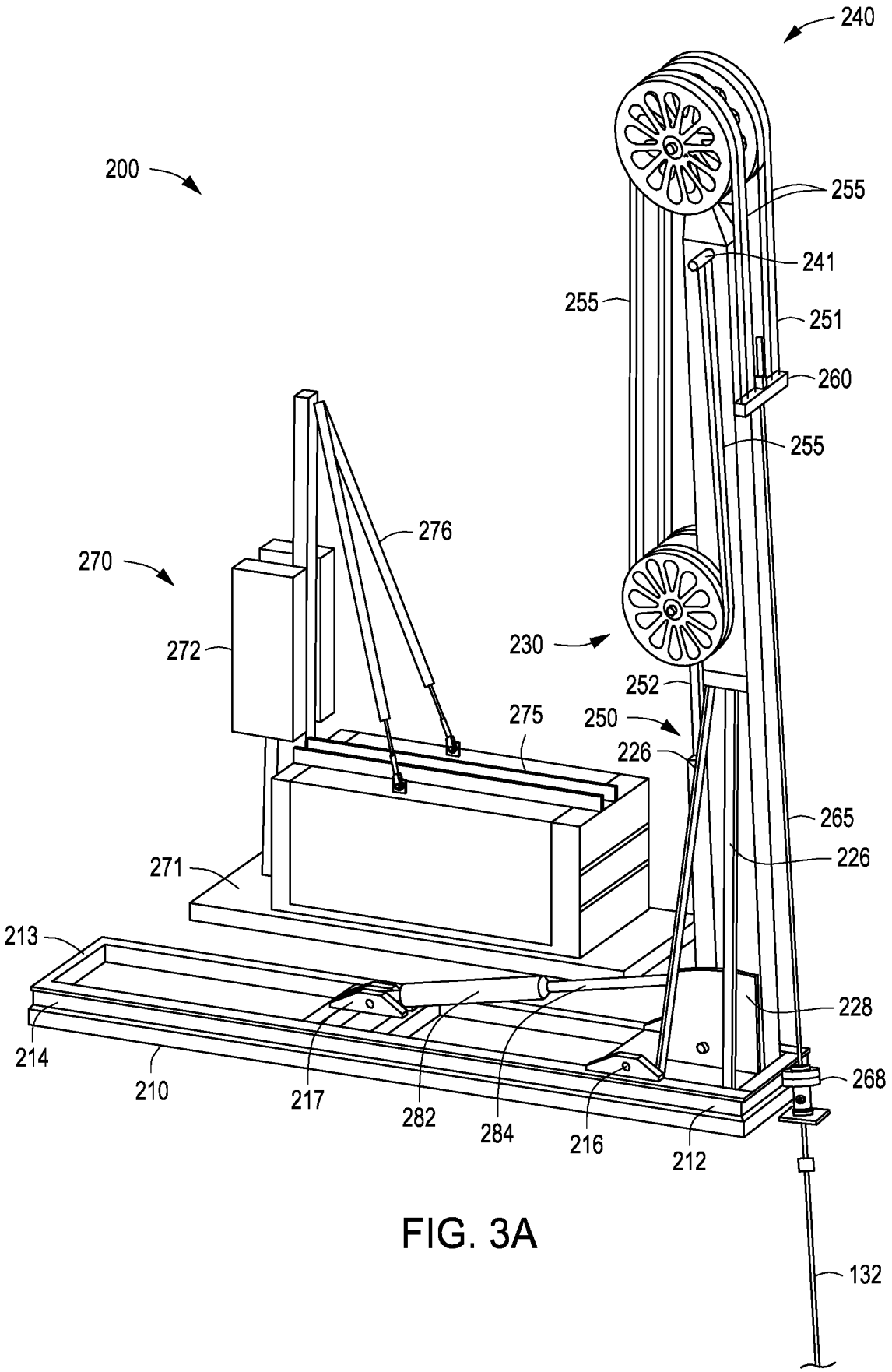
FIG. 3A is a perspective view of the rod pumping unit of the present invention, in another position. In this view, the traveling sheave is in its lowered position, and the operatively connected polished rod is in its raised position. Also visible is the counter-weight powerhouse system.

FIG. 3A is a perspective view of the rod pumping unit 200 of the present invention, in another position. In this view, the traveling sheave 240 is in its lowered position. The result is that the polished rod 265 is moved to its raised position.

Figure 3B:
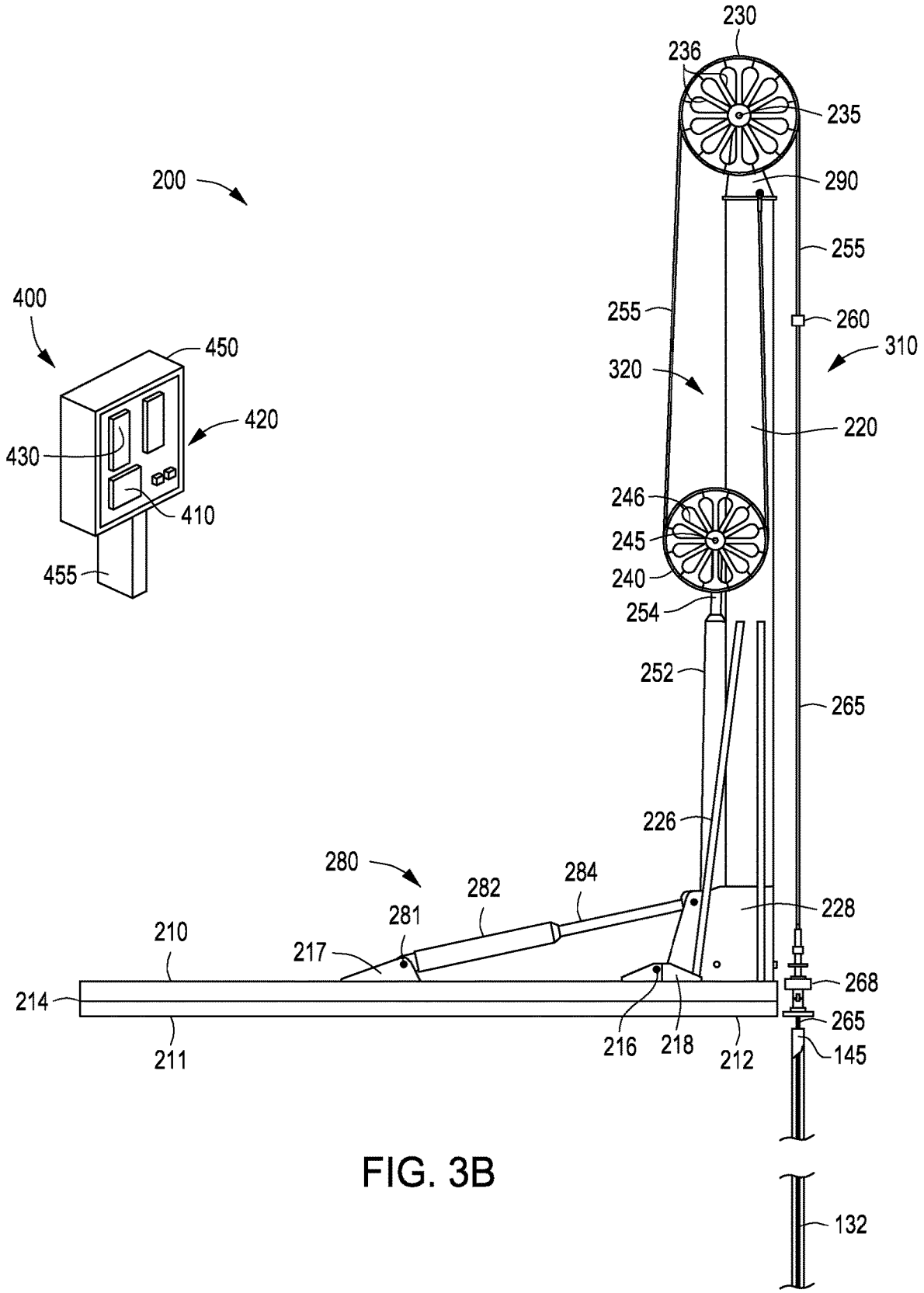
FIG. 3B is a side view of the rod pumping unit of FIG. 3A. Also shown is the control panel box having a master controller.
Figure 3C:
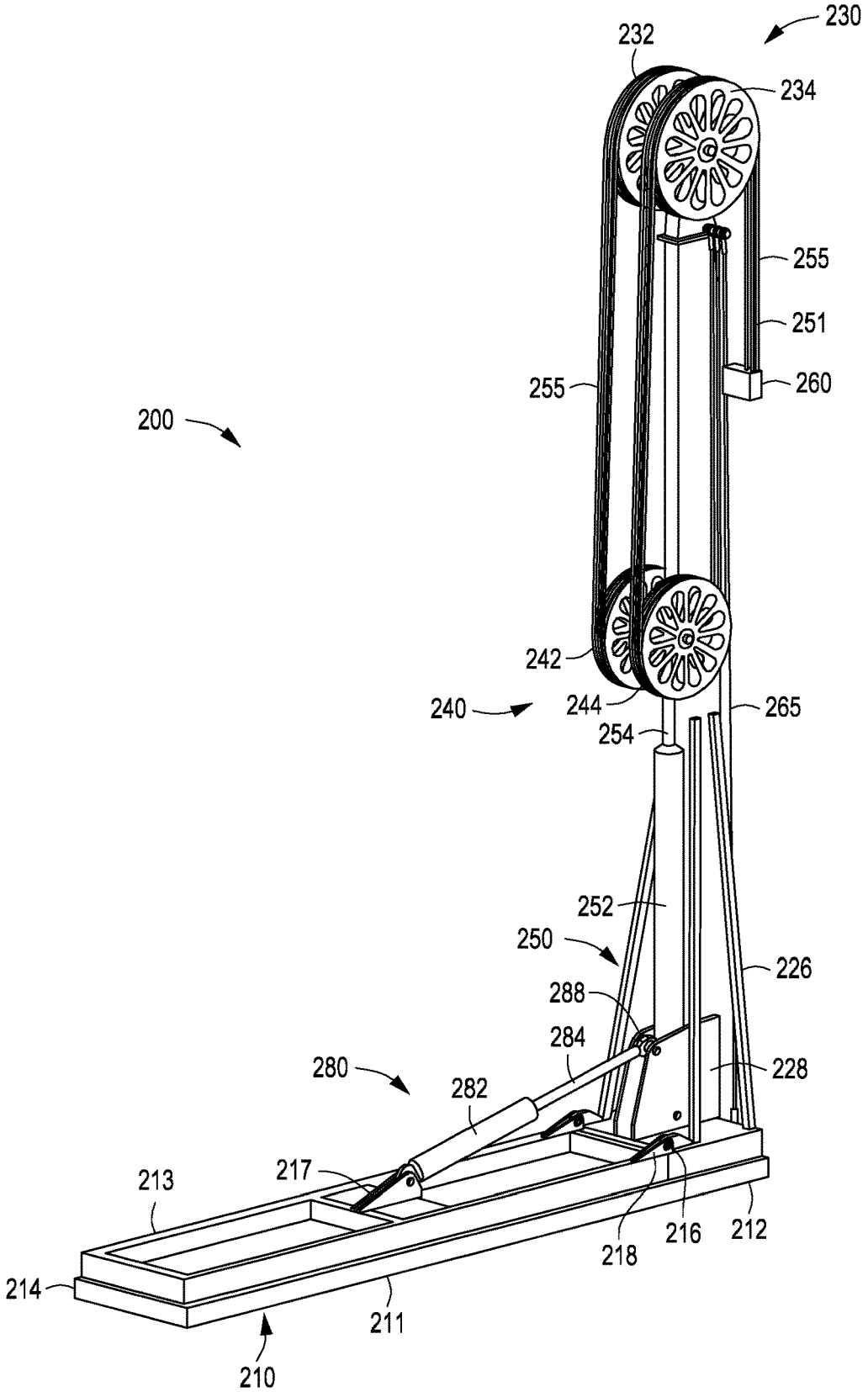
FIG. 3C is another perspective view of the rod pumping unit of FIG. 3A. The counter-weight powerhouse system has again been removed for clarity.

FIG. 3B is a side view of the rod pumping unit 200 of FIG. 3A. FIG. 3C is another perspective view of the rod pumping 200 unit of FIG. 3A. Note that in each of these views, the rod 354 of the linear actuator 350 has retrieved into the barrel 352 and is all but unseen.

As observed above, the piston rod 254 and operatively connected wire ropes 255 and polished rod 265 remain in tension at all times during operation. This is due to the weight of the rod string 132 connected to the polished rod 265. The result is that the rod pumping unit 200 is gravitationally biased in its downstroke position. Thus, the work required to move the traveling sheave 240 resides in pulling the traveling sheave 240 back down the back side 320 of the vertical support column 220, thereby pulling the rod string assembly out of the wellbore.

To provide this energy, and as an optional feature, the rod pumping unit 200 may include a counter-weight system 270. The counter-weight system 270 is seen in each of FIGS. 2A and 3A. The counter-weight system 270 first comprises a platform 271. Preferably, the platform 271 is a concrete pad, or base. Alternatively, a metal frame may be employed.

The counter-weight system 270 also includes a counter-weight 272. In the arrangement of FIGS. 2A and 3A, the counter-weight 272 represents a pair of plates, or preferably multiple plates of steel or other dense material. The plates 272 move up and down along a working beam 274. Movement is assisted by means of a roller support mechanism (seen in FIG. 7A at 278) that guides a counter-weight hydraulic cylinder piston rod assembly (not shown) as it extends, thus lifting the plates 272.

Each of the plates 272 may weigh between 1,000 pounds and 30,000 pounds. The selected amounts will depend on the weight of the polished rod 265, the rod string 132, the connected traveling valve, and the fluid being lifted. The weight of the fluid, in turn, is dependent on the diameter of the downhole pump assembly, the length of the rod and tubing string within wellbore, and the density of the fluids being produced.

A pair of support braces (referred to as stiff-legs) 276 may provide lateral support to the working beam 274. The stiff-legs 276 are secured at proximal ends to a powerhouse module 275. The stiff-legs 276 are secured at distal ends to the working beam 274.

It should be mentioned here that the powerhouse module 275 is an optional feature used to house various components of the rod pumping unit 200. These may include the main prime mover and hydraulic pumps, high voltage motor controls, the control panel box 400 and its 24 volt dc control system, plus the hydraulic fluid pumping system 300 as shown in FIG. 9A or 9B. All fluid lines plus the electric supply lines will interface through one or more walls of the powerhouse module 275. Operation of the hydraulic fluid pumping system 300 is discussed further below.

In operation, the counter-weight plates 272 move up the working beam 274 when the polished rod 265 and connected rod string 132 move down into the wellbore 170. The weight of the polished rod 265 and connected rod string 132 and fluid loads pull the traveling sheave 240 up the vertical support column 220. This is before the weight transfer takes place downhole. In this raised position, the piston rod 254 of the linear actuator 250 extends out of the barrel 252. This is shown in FIG. 2A. Then, to pull the polished rod 265 and connected rod string 132 back out of the wellbore 170, the hydraulic pump 340 moves the piston rod 254 back into its barrel 252. More specifically, hydraulic fluid is pumped against a plunger 257 associated with the piston rod 254 to urge the piston rod 254 back into the barrel 252 of the linear actuator 250. This causes an upstroke of the polished rod 265, pulling the traveling sheave 240 and operatively connected carrier bar 260 with it. This is shown in FIG. 3A. During this cycle, the plates 272 gravitationally slide back down the working beam 274, thereby assisting the pump in moving the piston rod 254 into the barrel 252.

Figures 1, 3D:
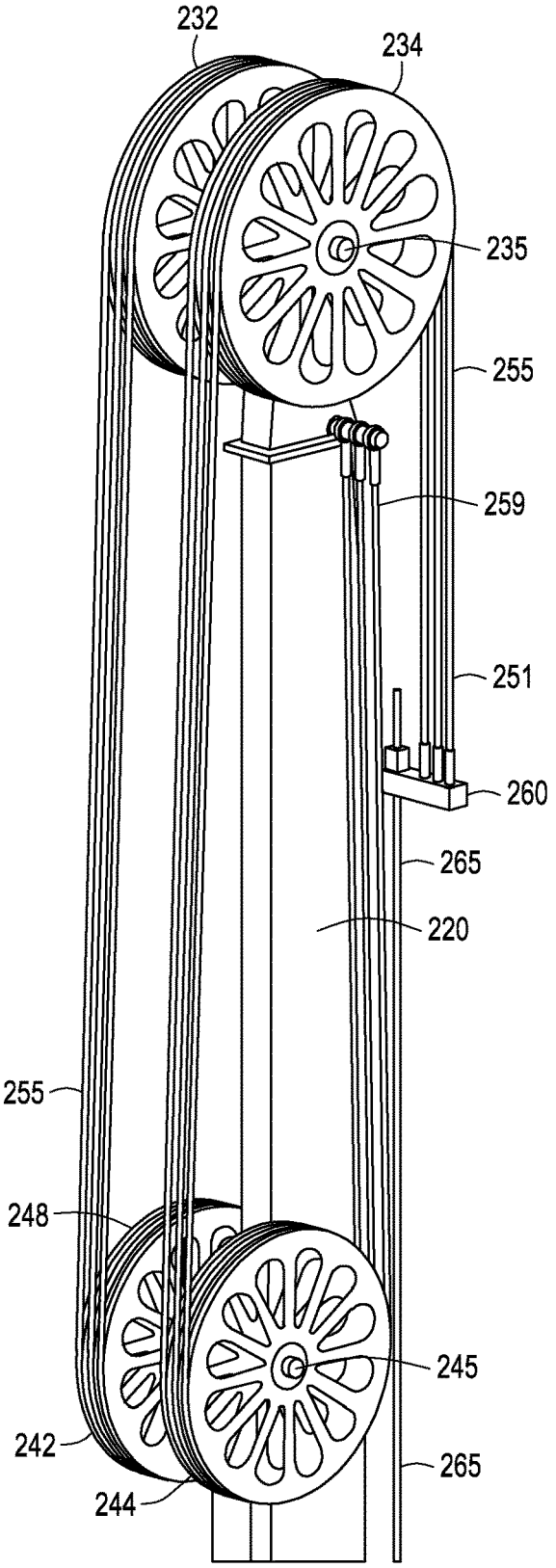
Figures 2, 3D:
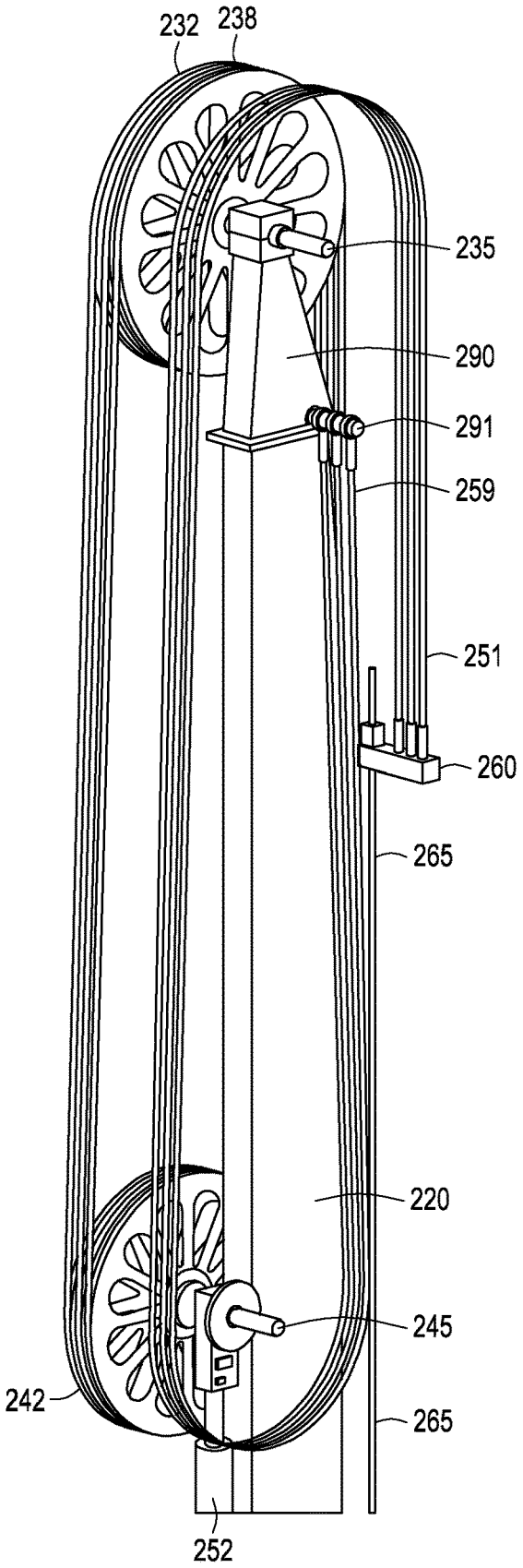
Figure 3E:
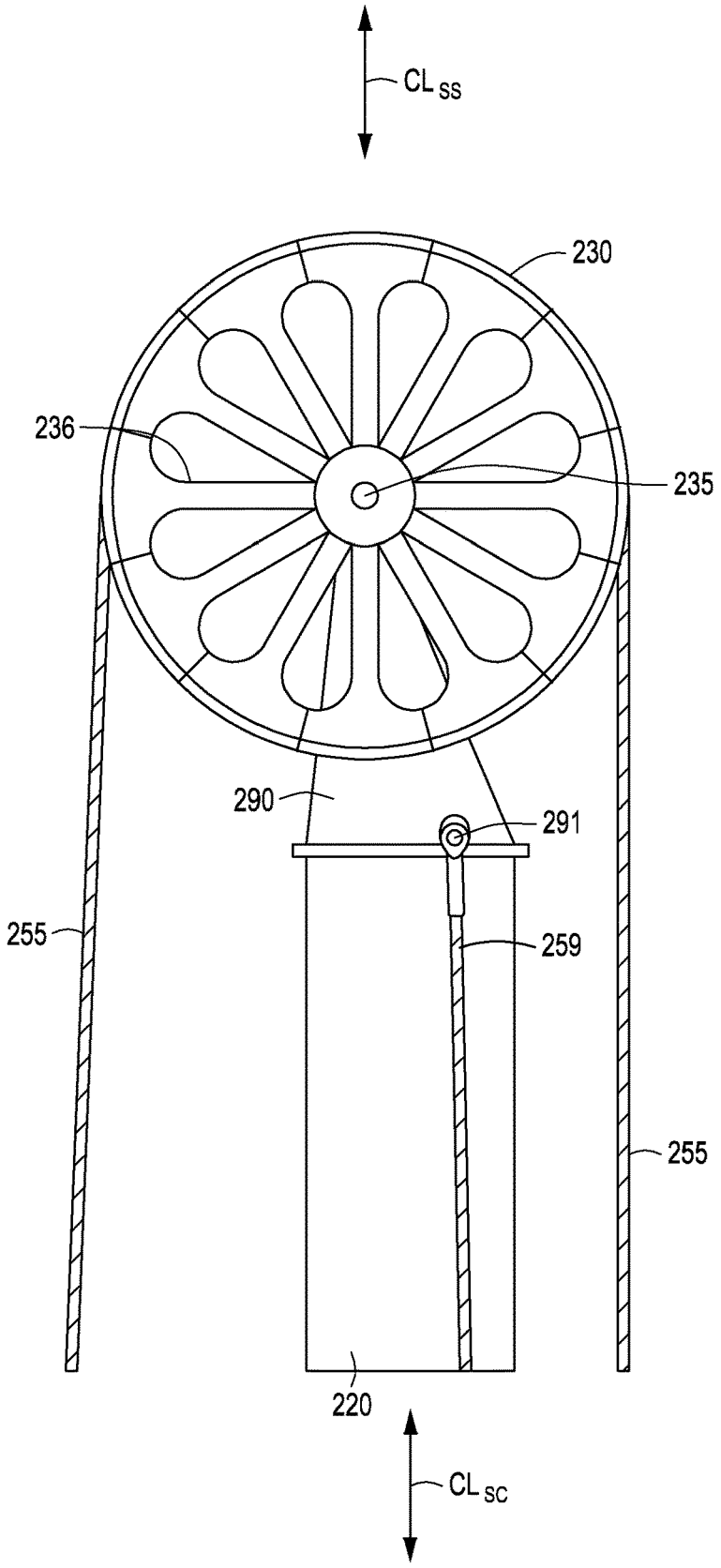
FIG. 3E is an enlarged side view of the standing sheave of FIG. 3B. A pin holding the distal end of the wire ropes on one side of a support crown is shown. Of interest, vertical center-lines for the standing sheave and the vertical support column are presented.

FIG. 3D-1 is an enlarged, perspective view of the standing sheave 230 and the traveling sheave 240 of FIG. 3A. The wheels 232, 234 of the standing sheave 230 and the wheels 242, 244 of the traveling sheave 240 are again supported by the vertical support column 220. The view of FIG. 3D-1 is the same as the view of FIG. 2D-1, except now the traveling sheave 240 is in its lowered position.

It is once again seen that six wire ropes 255 are wound over the wheels 232, 242, 234, 244. The ropes 255 are pinned at their distal ends 259 using pin 291. It is understood that pin 291 receives three wire ropes 255 on one side of the crown 290, and then three ropes 255 on the opposing side of the crown 290.

FIG. 3D-2 is another enlarged, perspective view of the standing sheave 230 and the traveling sheave 240 of FIG. 3A. Here, wheel 234 of the standing sheave 230 and wheel 244 of the traveling sheave 240 have been removed for illustrative purposes. A portion of axles 235 and 245 are again visible due to removal of the wheels 234, 244.

FIG. 3E is an enlarged, side view of the rod pumping unit 200 of FIG. 3A. The standing sheave 230 is shown more clearly. Note that the traveling sheave 240 is not visible in this view as the traveling sheave 240 is in its lowered position. The vertical center-line $CL_{SS}$ is shown for the standing sheave 230. while the vertical center-line $CL_{SC}$ is shown for the vertical support column 220.

The pin 291 holding the distal end 259 of the wire ropes 255 on one side of the crown 290 is seen. Note again that a relative angle is provided between the wire ropes 255 and the center-line $CL_{SC}$ of the vertical support column 220. In this position, the relative angle of the wire ropes 255 is about 1.5 degrees.

Figure 6B:
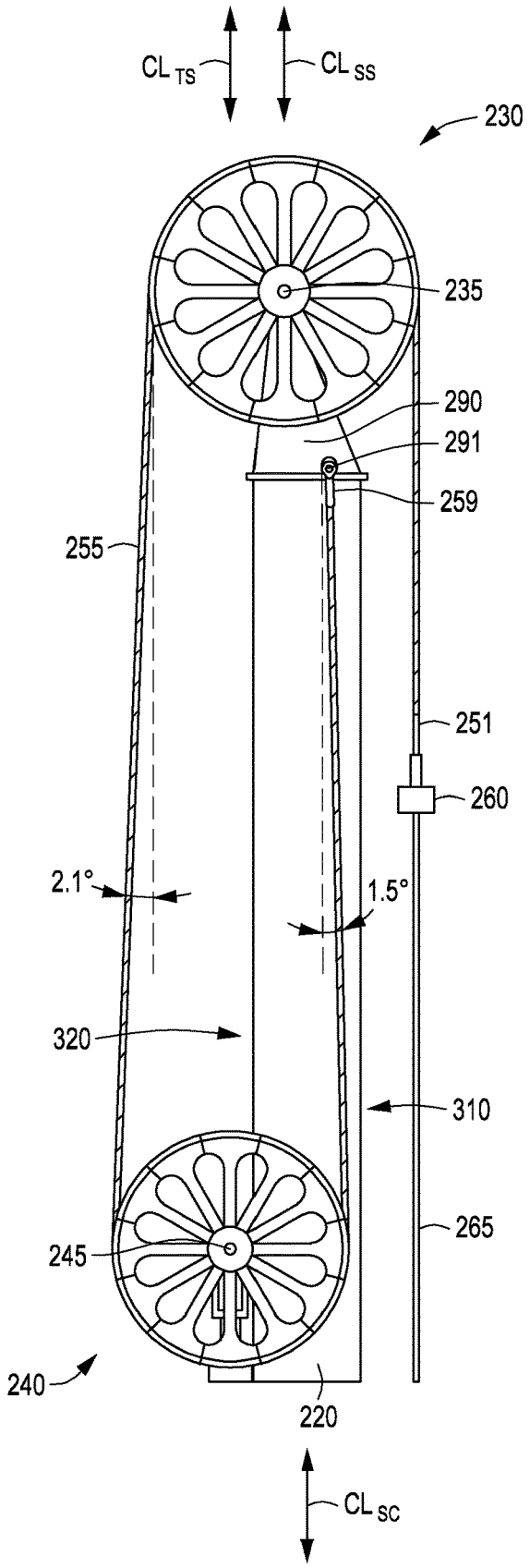
FIG. 6B is an illustrative side view of a portion of the rod pumping unit of FIG. 3E. The traveling sheave is in its lowered position. Relative angles of the wire ropes along each side of the traveling sheave are again presented.

FIG. 6B is an illustrative side view of a portion of the rod pumping unit 200 of FIG. 3E. Relative angles of the wire ropes 255 along each side of the traveling sheave 240 are presented. On the front face 310 of the vertical support column 220, the relative angle is shown at about 1.5 degrees. Similarly, on the back side 320 of the vertical support column 220, the relative angle is shown at about 2.1 degrees. These angles are merely illustrative; what is important is that these two angles are essentially the same, e.g., within 2 degrees of each other, so as to provide load balancing along the vertical support column 220 and the linear actuator 250. This, in turn, minimizes the side load exerted into the support column 220 while the traveling sheave wheels 242, 244 move through their range of motion from top to bottom, and back up.

It is noted that the angle of the wire rope 251 between the standing sheave 230 and the carrier bar 260 is always 0 degrees relative to $CL_{SC}$.

Figure 4A:
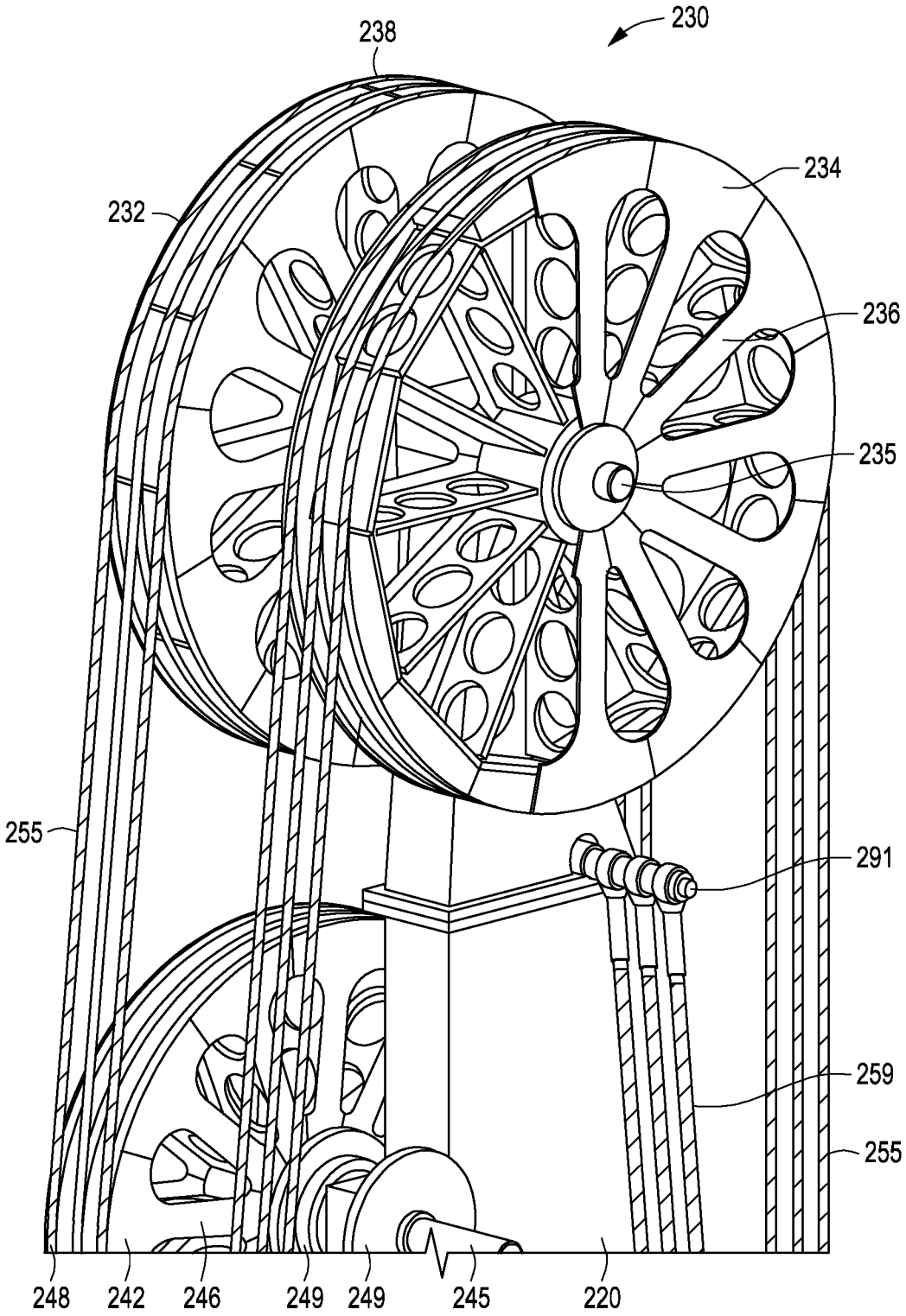
FIG. 4A is a perspective view of the standing sheave of FIG. 2A. The standing sheave is shown as a pair of wheels.

FIG. 4A is a perspective view of the standing sheave 230 of FIG. 2A. The standing sheave 230 is again shown as a pair of wheels 232, 234. The pivoting connection between the distal end 259 of the wire ropes 255 and the pin 291 is more visibly seen. The pin 291 is shown extending into the crown 290 above the vertical support column 220.

Additional features of the rod pumping unit 200 are also more readily visible in FIG. 4A, including the spokes 236 of the wheels 232, 234. Grooves 238 for receiving the wire ropes 255 are also shown. Also seen with greater clarity is the crown 290, which is welded or bolted onto the top of the vertical support column 220. Finally, a bearing wheel 249 is shown along axle 245. The bearing wheel 249 provides the mechanism that allows the traveling sheave 240 to roll up and down along the back side 320 of the support column 220.

In the arrangement of FIG. 4A, a pair bearing wheels 249 is utilized, with each bearing wheel 249 having a plate connected to or that is integral with the wheels 242, 244. Of interest, the bearing wheels 249 have a dynamic load balancing force applied to them from the wire rope 255 forces, reducing the supportive load against the support column 220. Stated another way, the two bearing wheels 249 allow the transfer of load induced from the one-degree lean of the linear actuator 250. The bearing wheels 249 guide and rigidly support the dynamic operating loads.

Figure 4B:
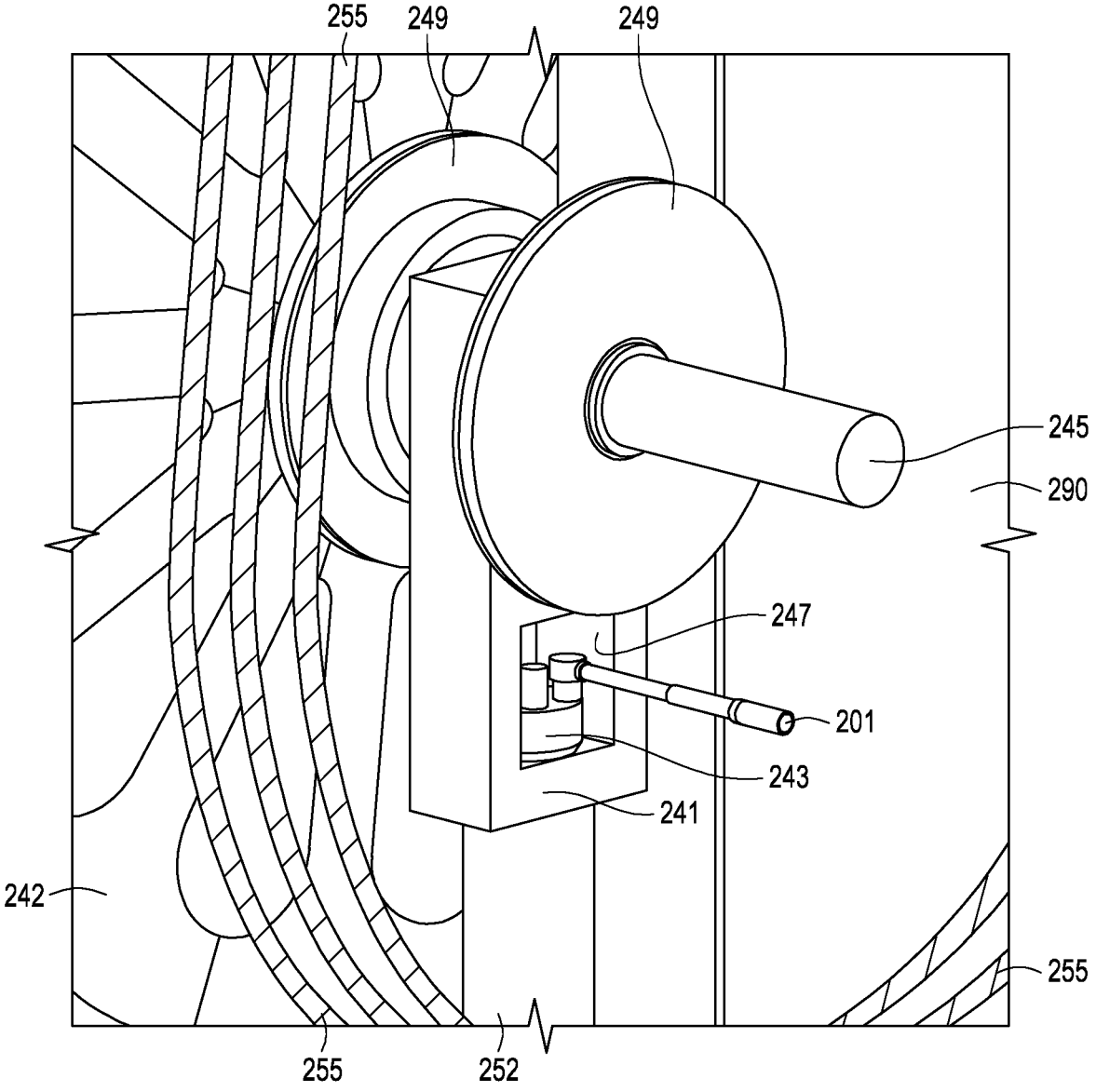
FIG. 4B is a perspective view of a mechanical connection between the piston of the linear actuator and the axle of the traveling sheave.

FIG. 4B is a perspective view of a mechanical connection between the piston rod 254 of the vertical linear actuator 250 and the axle 245 of the traveling sheave 240. Once again, wheel 244 has been removed from the axle 245 for illustrative purposes.

It can be seen that a box 241 connects the piston rod 252 to the axle 245. The box 241 has a first opening (not visible) that receives the axle 245. The bearing wheels 249 reside on opposing ends of the box 241. The box 241 has a second opening 247 that receives a pre-threaded flange 243. The flange 243 is threaded onto an end of the piston rod 252 using a male x female thread connection, with the smaller bolts being threaded in and tightened down onto the flange 243 using a ratchet 201. A hardened flat washer (not shown) may be placed between the threaded connection and the flange 243. As the bolts are threaded into place, the hardened flat washer is pushed down. This serves to pre-load the male threads associated with the piston rod 252 and the female pre-threaded flange 243.

Figure 5:
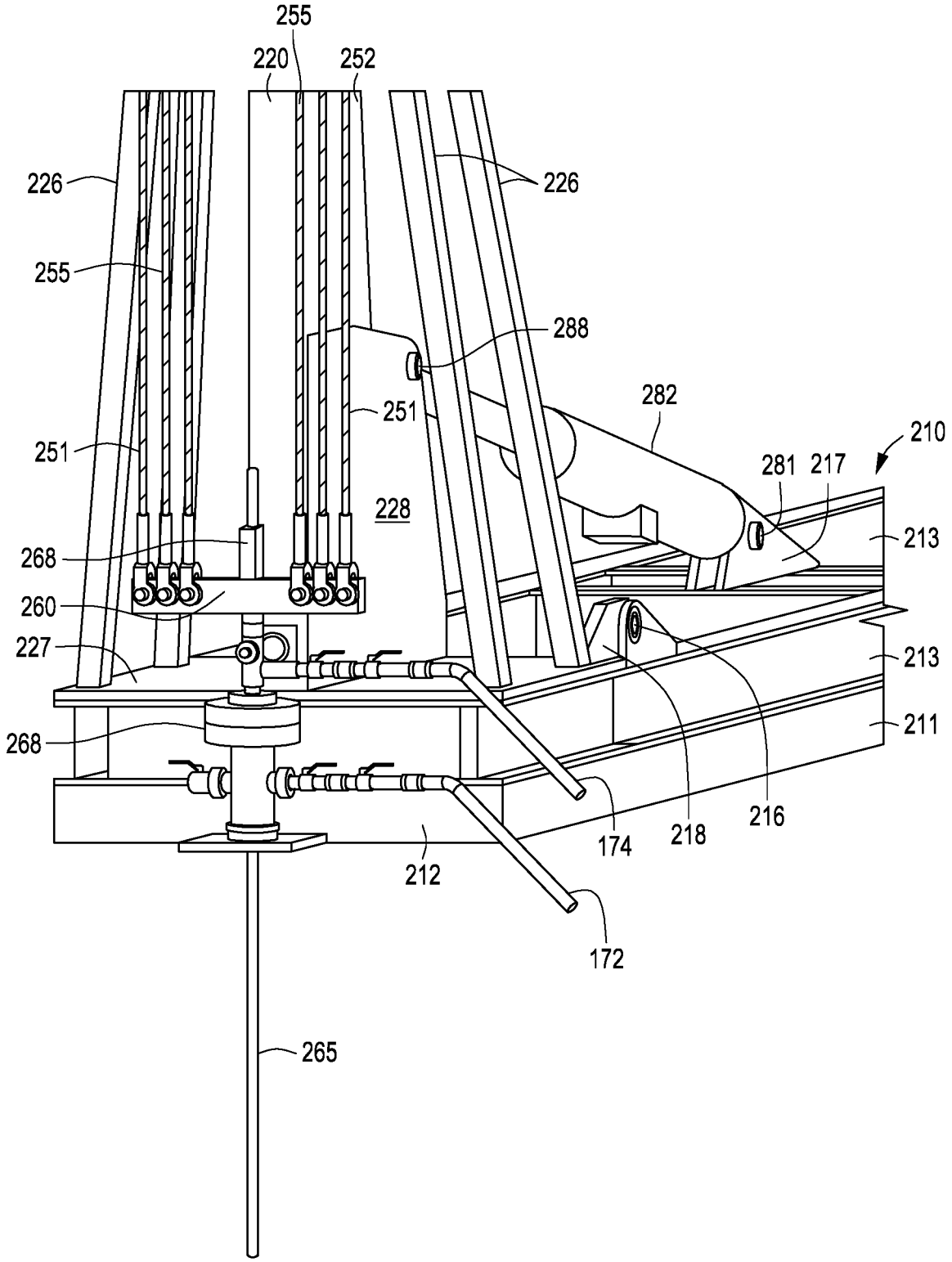
FIG. 5 is an enlarged, perspective view of a portion of the rod pumping unit of FIG. 2A. Here, the front end of the horizontal support base is shown. Also visible is the carrier bar and the connected polished rod. The polished rod is shown extending through the stuffing box.

FIG. 5 is an enlarged, perspective view of a portion of the rod pumping unit 200 of FIG. 2A. Here, the front end of the horizontal support base 210 is shown. Of interest, the pinned connection between six separate wire ropes 255 and the carrier bar 260 is visible. The carrier bar 260, in turn, is connected to the polished rod 265. The wellhead with stuffing box is seen at 268, slidably receiving the polished rod 265.

Other features of note that are well-visible in FIG. 5 include the lateral support bars 226, the bottom plate 227 and the support plates 228. Also visible are the cement pad 211, the frame 213 and the pin 216. Also visible is the polished rod clamp 268 that supports the weight of the polished rod 265 preventing the mechanical connection from slipping as the polished rod 265 is lifted and lowered during operation.

FIG. 7A is another perspective view of the rod pumping unit 200 of the present invention, in one embodiment. Here, the vertical support column 220 has been folded over onto the horizontal support base 210. This is a transport position, also called a well work over position. In this position, the rod pumping unit 200 may be delivered to a well site having a previously prepared well pad. Upon delivery, a mobile hydraulic crane (not shown) unloads and positions the rod pumping unit 200 onto its concrete footing base 211.

FIG. 7A also shows the counter-weight powerhouse system 270. Here, the working beam 274 has also been folded over onto the powerhouse module 275. Note that the counter-weight plates 272 have been removed for illustration. A roller bearing 278 is now seen along the working beam 274. This too is the transport position. A front trunnion hydraulic cylinder mount connection is shown at 277.

Using the same crane, the counter-weight system 270 with its powerhouse 275 are lifted onto a concrete base 271. The counter-weight system 270 is also positioned and anchored adjacent the horizontal support base 210.

Once the counter-weight powerhouse system 270 is in position and anchored to its concrete base 271, the crane pivots the working beam 274 to its vertical working position. Both stiff legs 276 are swung into place and are bolted tightly into position. The crane hook is released, and is now ready for the counter-weight plates 272. The crane lifts and swings the plates 272 into position, with the field technician providing final guidance of each plate 272 onto the working beam 274. The plates 272 are then pinned into place so that they do not fall away from the axle of the working beam 274.

Rotation of the vertical support column 220 of the rod pumping unit 200 over onto the horizontal support base 210 is by means of pin 216. The horizontal cylinder 282 is used to raise the large vertical support column 220 so that the front face 310 faces a wellhead 110. Once both modules, that is, the rod pumping unit 200 and the counter-weight powerhouse system 270, are in place, the modules are fluidly connected together through pipes and flexible conductors (or hoses).

The carrier bar 260 is secured onto the polished rod 265 using polished rod clamps securely fastened to the polished rod 265 above the carrier bar 260. This will require lowing the carrier bar 260.

Of interest, the controller 410 allows the operator to manipulate the position of the carrier bar 260. Conventional oilfield practice on adjusting pump spacing requires the use of two sets of polished rod clamps or means of holding the polished rod in place as the top clamp position is measured and re-positioned in correct location. Once the polished rod is able to be moved by the surface unit, another set of rod clamps is secured below the carrier bar. The carrier bar is then lowered either to contact the well head or approved load support device able to hold the weight of the polished rod, thus unweighting the carrier bar. The top rod clamp(s) are loosened, the carrier bar is moved up or down on the polished rod, then the top rod clamps are tightened. This setting changes the position of the traveling valve in relation to the standing valve at full bottom of stroke.

Once the carrier bar 260 is connected to the polished rod 265 in the right position, the oilfield operator has the ability to start, stop and hold the position of the carrier bar 260 and connected polished rod string 265 at any position. This may be done through a remote control unit that communicates with the controller 410 through wireless signals or that is tethered with a physical cable connection.

FIG. 8 is an enlarged, perspective view of the hinged connection between the horizontal support base 210 and the vertical support column 220. In this view, the base plate 227 and connected vertical support column 220 are back in a raised position. The placement of pivot pins 216 is visible. Production connections are made at the wellhead to the production tubing output 172 and the casing annulus output 174 (seen in FIG. 1). The rod pumping unit 200 is now ready for operation.

Of interest, FIG. 8 shows a pinned connection between a lower end of the near-vertical linear actuator (hydraulic cylinder, or "barrel" 254) and the base plates 228. The pinned connection allows the hydraulic cylinder 254 of the near-vertical linear actuator 250 to be fixed relative (or pinned above) to the horizontal support base 210.

After a period of production, the vertical support column 220 may be rotated back onto the horizontal support base 210. This allows a working crew to access the wellhead 170. This also facilitates transportation of the rod pumping unit 200 off of the cement pad 211 and to another well, or to a storage yard if desired.

FIG. 7B is a side view of the rod pumping unit 200 of FIG. 7A. FIG. 7C is another perspective view of the rod pumping unit 200 of FIG. 7A. In each of these views, the vertical support column 220 is folded over onto the horizontal support base 210.

Of interest, a tension strap 261 may be used in transport, and anytime well workover is demanded, to secure the wire ropes 255 and the carrier bar 260 in place. Specifically, the strap 261 has a proximal end 262 secured to the vertical support column 220 and a distal end secured to the carrier bar 260. In the transport position, the traveling sheave 240 is moved to its lowered position and secured in place with mechanical connections. This is shown best in FIG. 7B. The proximal end 262 of the strap 261 is secured to the support column 220. Then, the tension strap 261 is installed and pulled up so that the distal end 264 is secured to the carrier bar 260 when the support column 220 is in its vertical position. This is done prior to be laid horizontal.

Once the tension strap 261 is connected to the carrier bar 260, it is lifted to approximately 85% of its raised position. This puts tension into the straps 261, keeping the wire ropes 255 in place. This is done by lowering traveling sheave wheels 242, 244 along the back side 320 of the vertical support column 220. This reduces the center of gravity of the vertical support column 220 making it safer to pivot.

To assist in the controlled rotation of the vertical support column 220, either up or down, a near-horizontal actuator 280 may be provided. The horizontal actuator 280 resides along and on top of the horizontal support base 210. The horizontal actuator 280 has a proximal end 282 that is operatively connected to the frame 213 of the horizontal support base 210. Preferably, the proximal end 282 defines a hydraulic barrel. The proximal end 282 is connected to a bracket 217 by means of a pin 281. In this way, a hinged connection is formed. (Again, some may refer to this as a rod-eye clevis arrangement.) Alternatively, the cylinder 282 may mounted using a front trunnion style of cylinder mounting to reduce piston rod loading stress and strain.

The horizontal actuator 280 also includes a distal end 284. The distal end 284 preferably defines a telescoping rod, or piston rod that extends and retracts out of the barrel 282. The piston rod 284 is pinned to the base plates 228 by pin 288. Pin 288 is best seen in FIG. 5.

Hydraulic fluid resides in the barrel 282. Fluid may be pumped under pressure against a plunger 287 (shown in FIG. 9A and discussed below) associated with the piston rod 284 to move the piston rod 284 up into its raised position. The barrel 282 may be, for example, between 3 and 8 feet in length, while piston rod 284 may be between 5 and 15 feet in length, depending on the size of the unit 200.

In the view of FIGS. 7A, 7B and 7C, the piston rod 284 of the horizontal actuator 280 has been moved substantially into the barrel 282. In the views of FIGS. 2A, 2B, 2C, 3A, 3B and 3C, the piston rod 284 of the horizontal actuator 280 has extended out from the barrel 282. Movement of the piston rod 284 takes place in response to changes in hydraulic pressure applied to a piston.

As noted above, a separate plunger 257 is also shown in FIG. 9A, Movement of the plunger 257 causes the connected piston rod 254 to cycle up and down along the back side 320 of the vertical support column 220. This, in turn, moves the carrier bar 260 and connected polished rod 265 from a lowered (or downstroke) position to a raised (or upstroke) position.

Movement of each of pistons 257, 287 may be by means of the application of hydraulic fluid under pressure. FIG. 9A is a highly schematic view of a hydraulic fluid pumping system 300, in one embodiment. The hydraulic fluid pumping system 300 is used for raising and lowering the traveling sheave 340 in response to movement of the linear actuator 250. As discussed above, this causes the carrier bar 260 and connected polished rod 265 to reciprocate.

In the arrangement of FIG. 9A, the hydraulic fluid pumping system 300 is an open loop system. The linear actuator 250 is shown in FIG. 9A in cut-away view. A lower portion of the piston rod 254 is seen extending into its barrel 252. A plunger 257 is seen attached to the bottom of the piston rod 254.

Also as discussed above, the vertical support column 220 is raised and lowered at least in part by motion of the horizontal actuator 280. The hydraulic actuator is operated within the open loop hydraulic system. The horizontal actuator 280 is also shown in FIG. 9A in cut-away view. A lower portion of the piston rod 284 is seen extending into its barrel 282. A plunger 287 is seen attached to the bottom of the piston rod 284.

Components of the hydraulic fluid pumping system 300 primarily reside within the powerhouse module 275. The powerhouse module 275, in turn, is supported on the cement pad 371. In the view of FIG. 9A, the powerhouse module 275 is largely cut-away so that components of the hydraulic fluid pumping system 300 may be visualized.

The hydraulic fluid pumping system 300 first includes a prime mover 330. The prime mover 330 provides power to the fluid pump 340. The prime mover 330 may be a gasoline engine, a diesel engine, or other internal combustion engine. More preferably, the prime mover 330 is an electric motor. The electric motor 330 may receive three-phase power from the grid, or may be powered by a so-called industrial gen-set. When the prime mover 330 is started, it activates the fluid pump 340. Changing the operating speed of the prime mover 330 will vary the output of the pump 340. Alternatively, different types of control such as regulating actual pump displacement and direction of fluid flow or valving can be used to vary the hydraulic output flow and direction with a fixed RPM in the pump 340.

The hydraulic fluid pumping system 300 also includes the fluid pump 340. In one aspect, the pump 340 serves to pump fluid into oil lines 365 and 368. Oil line 365 is used to move the piston rod 254 of the vertical linear actuator 250, while oil line 368 is used to move the piston rod 284 of the horizontal linear actuator 280. Of course, it is understood that a separate hydraulic pump or other power system could be used to move the piston rod 284 of the horizontal linear actuator 280. It is also understood that the horizontal linear actuator 280 could be part of a closed loop hydraulic system as is shown in the more preferred arrangement of FIGS. 9B and 9C.

In the embodiment shown in FIG. 9A, the pump 340 cycles between a counter-weight blind end cylinder forcing the counter-weight plates to be lifted, and a vertical cylinder rod end port. This creates a teeter-totter action. In this instance, the pump 340 is a bi-directional pump. At the same time, the prime mover also changes direction and provides full torque down to zero RPM.

In the arrangement of FIG. 9A, the hydraulic fluid pumping system 300 additionally includes a pair of oil lines 365, 368. Oil line 365 injects fluid under pressure into the barrel 352 above the plunger 257. Similarly, oil line 368 injects fluid under pressure into the barrel 382 below the plunger 287. It is understood that the two actuators 250, 280 are never operated at the same time.

The hydraulic fluid pumping system 300 further includes a master fluid valve 350. The master fluid valve 350 is controlled by the controller 410. In the arrangement of FIG. 9A, the master fluid valve 350 represents a collection of valves that direct the flow of hydraulic fluid through the oil lines 365, 368. The valve stack 350 facilitates a teeter-totter flow of energy that moves the components of the rod pumping unit 200. The valve stack 350 also controls the return of oil through the vent lines 355, 385.

The controller (such as controller 410 of FIG. 2B) is programmed to control movement of the linear actuator 250 by sending signals to (i) start and stop movement of the linear actuator 250, and (ii) control a speed of the upstroke of the polished rod 265, a speed of the downstroke of the polished rod 265, or both. In one aspect, the controller 410 is configured to control the downstroke speed of the polished rod 265 within established minimum and maximum downstroke speeds, and to control the upstroke speed of the polished rod 265 within established minimum and maximum upstroke speeds. Included within the speed control described above are acceleration and deceleration rates providing for smooth transitions of direction and speed changes. Beneficially, the controller 410 may also be configured to start, stop and hold a position of the polished rod 265 at the manual command of the operator, such as by control panel 420.

The controller 410 may also adjust the stroke length of the polished rod within defined limits. This allows an operator to select a desired pump size, or to limit stroke length if pump fillage is only partial.

The hydraulic fluid pumping system 300 also includes a pair of return lines 355, 358. The return lines 355, 358 are essentially vent lines. The return lines 355, 358 receive air and any leaked oil during operation of the rods 254, 284. Return line 355 returns fluid into the valve stack 350 from below the plunger 257. At the same time, return line 358 returns fluid back to the valve stack 350 from above the plunger 287.

The hydraulic fluid pumping system 300 also includes a fluid reservoir 360. The reservoir 360 holds the working fluid for the system 300. Preferably, the fluid is a clean oil. Oil lines 365, 368 deliver fluid from the fluid reservoir 360 to the barrel 352 and the barrel 382, respectively as an open loop system.

In operation, the pump 340 causes oil to be moved from the fluid reservoir 360, through oil line 365, and into an annular area within the barrel 352. The oil acts against the plunger 257, causing the plunger 257 and connected piston rod 254 to be lowered. This accomplishes the upstroke of the polished rod 265 and the mechanically connected rod string 132 and downhole pump. To effectuate the downstroke, oil is vented back through vent line 355 and into the fluid reservoir 360 (or, optionally, into a barrel associated with the counter-weight system 370. Rate of descent of the polished rod assembly may again be controlled through the valve stack 350 through settings provided by controller 410.

FIGS. 9B and 9C provide schematic views of a hydraulic fluid pumping system 900 as may be used with the rod pumping unit 200 of the present invention, in a second embodiment. In this second embodiment, a closed loop pumping system is provided. Those of ordinary skill in the art of high pressure hydraulic fluid circuits will understand that a closed loop pumping system requires a charge pump supply to maintain low side loop pressure. This charge pressure of the main pump makes up for fluid exchange within the closed loop. The charge pressure provides a means to continually exchange, filter and cool the closed volume of fluid normally trapped within a closed loop hydraulic circuit. These types of closed circuits are not typically dependent on "valving" that directs or restricts fluid flow as with the system of FIG. 9A. Closed loop hydraulic systems allow for energy transfer and reclamation of kinetic energy when applied in such applications. Closed loop systems can precisely control fluid flow rate, direction of fluid flow and pressure limitation when controlled by a smart pump and controller.

In each of FIGS. 9B and 9C, a pair of vertical linear actuators is shown. The first linear actuator is seen at 250. This is the vertical linear actuator described above that is used to move the traveling sheave 240 up and down along the vertical support column 220. The barrel 252, the plunger 257 and the piston rod 254 of the vertical linear actuator 250 are visible.

Also shown is an oil line $O_S$. The oil line $O_S$ is in fluid communication with the barrel 252 by means of an oil port $P_S$. In the view of FIG. 9B, oil is being pumped through a port $P_S$ and into the barrel 252. Increased pressure above the plunger 257 causes the plunger 257 and connected piston rod 254 to move downward in the barrel 252. This, in turn, moves the operatively connected polished rod (not shown) in an upstroke. Thus, the polished rod and connected downhole pump (and fluid load) are being raised out of a wellbore, against gravitational forces.

The second linear actuator is linear actuator 970. This vertical linear actuator is used to move the counterweight plates 272 up and down along the working beam pole (shown at 274 in various figures). Vertical linear actuator 970 also includes a barrel 972, a plunger 977 and a piston rod 974. In one aspect, the piston rod 974 is offset within the barrel 972 in accordance with the hydraulic lift system taught in U.S. Pat. No. 8,083,499, although a conventional centered design may also be employed.

Also shown in FIGS. 9B and 9C is an oil line $O_P$. The oil line $O_P$ is in fluid communication with the barrel 972 by means of an oil port $P_P$. In FIG. 9B, oil is being released through a port $P_P$ from the barrel 972. Decreased pressure below the plunger 977 causes the plunger 977 and connected piston rod 974 to move downward in the barrel 972. This, in turn, moves the operatively connected plates 272 in a downstroke. Downward movement of the plates 272 is indicated by "P."

It is observed that for the barrel 252 associated with the vertical linear actuator 250, the oil line port $P_S$ is located above the plunger 257. In contrast, for the barrel 972 associated with the vertical linear actuator 950, the oil line port $P_P$ is located below the plunger 977. The result is that movement of oil from barrel 972 into barrel 252 causes both of plungers 257 and 977 to move down together.

By virtue of the placement of the ports $P_P$ and $P_S$ and the movement of fluid through the hydraulic pump 950, the two plungers 257, 977 move down together. The result in FIG. 9B is that the traveling sheave 242 moves down. This is indicated by arrow "T."

The hydraulic fluid pumping system 900 also includes the powerhouse module 275. The powerhouse module 275 houses a hydraulic pump 950. The hydraulic pump 950 moves oil in two different directions. The first direction is shown in FIG. 9B. Here, oil moves from the barrel 972 of the vertical linear actuator 970 for the counter-weight plates 272 and through oil line $O_P$. The oil then moves through the hydraulic pump 950 and into the oil line $O_S$. From there, the oil is pumped into the port $P_S$ of the barrel 252 above the plunger 257 of the vertical linear actuator 250 for the traveling sheave 240.

FIG. 9C is another schematic view of the hydraulic fluid pumping system 900 of FIG. 9B. Here, the counter-weight plates 272 are being raised (shown again at arrow "P") while the traveling sheaves 240 are also being raised (shown again at arrow "T"). This has the effect of lowering the polished rod in the wellbore.

In FIG. 9C, oil is being pumped out of the barrel 252 through the port $P_S$ and towards the hydraulic pump 950. Decreased pressure above the plunger 257 allows the plunger 257 and connected piston rod 254 to move upward in the barrel 252. This, in turn, moves the operatively connected polished rod in a downstroke.

Oil moves through oil line $O_S$ and into the hydraulic pump 950. From there, oil is pumped into the barrel 972 associated with the counter-weight plates 272. Oil then moves through oil line $O_P$, through port $P_P$, and into the barrel 972. Increased pressure below the plunger 977 will move the plunger 977 and connected piston rod 974 upward. This, in turn, moves the counter-weight plates 272 upward in accordance with arrow "P."

The result of the pumping of oil in FIG. 9C is that both of plungers 257 and 977 move up together.

FIGS. 9B and 9C show two sides to the hydraulic pump 950. These are indicated as an "A" port and a "B" port. Port A is connected to oil line $O_S$, while port B is connected to oil line $O_P$.

The energy to pump oil through oil lines $O_P$ and $O_S$ is provided by a prime mover 330. The prime mover 330 provides rotational torque energy to the pump shaft. The prime mover 330 is preferably an electric motor, although it may alternatively be a diesel engine or may run off of natural gas or natural gas liquids. When the prime mover 330 is an electric motor, energy is acquired from the power grid to initially power the closed loop pump 950. In any instance, the pump 950 is an over-center variable displacement high pressure pump capable of providing bi-directional variable flow.

The powerhouse module 275 also includes a precision metering valve 955. The valve 955 is referred to in the industry as a direct operated zero overlap servo valve. In the view of FIGS. 9B and 9C, the servo valve 955 represents a master fluid control valve. Movement of the master fluid control valve is controlled by the controller 410. The master fluid control valve regulates the position of the pump 950, such as through the use of a so-called swashplate. The swashplate is an equal area double ended linear actuator mechanically coupled to the pump and directly controls main pump 950 fluid flow rate and direction. The pump 950 and its swashplate have the ability to limit maximum pressure levels of fluid through the oil lines $O_P$ and $O_S$.

It is understood that the powerhouse module 275 includes a number of other components that make up a fluid circuit. These may include a fluid reservoir 360 and various conductor lines, sensors, solenoids and transducers (not shown).

The hydraulic fluid pumping system 300 may also optionally include a so-called iron lung (not shown). The iron lung provides a breathing function for the system 900, allowing for expansion and contraction of fluid as ambient temperature changes, and providing a barrier to prevent moisture and contaminants from entering the reservoir.

As can be seen, an improved rod pumping unit is provided. The rod pumping unit offers ultra-long pump strokes, scalable to even greater lengths. In one aspect, the rod pumping unit offers at least 480 inches of polished rod travel. Increased pump stroke length combined with use of a larger pump enables increased fluid displacement capability downhole. Increased pump stroke length also reduces rod reversals, thereby preserving the life of the rod string and surrounding downhole tubing.

As part of the rod pumping unit, a unique traveling sheave arrangement is provided. The wheels of the traveling sheave are configured to cancel out the majority of non-lifting forces. The vertical support column guides the traveling sheave wheels up and down in inverse relation to movement of the polished rod, which provides linear travel amplification. Of interest, the vertical support column does not support the counter-weight mechanism.

The rod pumping unit may be delivered to a well site in two separate modules, those representing the surface pumping unit and the counter-weight system. The rod pumping unit and its modularity of design allows multiple types of force and travel generating input mechanisms to power and reciprocate the traveling sheave. These include the use of counter weight plates (such as plates 272), an electric motor and a hydraulic fluid pump.

In one aspect, the rod pumping unit includes the ability to harvest the energy provided by gravity and the weight of the rod string during the down stroke by using an electrical regenerating turbine. Such "free" energy may be stored in a battery, a capacitor, a bank of super capacitors, or combinations thereof (collectively, an "energy storage device"). During the upstroke, current is sent from the energy storage device to an electric motor associated with the counter-weight system. The electric motor serves as the prime mover 330, which in turn drives the hydraulic pump 340. Such technology is described further in U.S. Pat. No. 8,562,308, which is incorporated herein by reference in its entirety.

Referring back to FIGS. 2A, 2B and 2C, the polished rod 265 is shown at its lowest lowered position. This is the most depleted energy position. Stated another way, the rod pumping unit 200 has expelled the greatest amount of falling kinetic energy. In contrast, in FIGS. 3A, 3B and 3C, the polished rod 265 and carrier bar 260 are at their highest raised position. This is the greatest energy requirement position. Stated another way, the rod pumping unit 200 has consumed the greatest amount of input energy to lift the polished rod 265, the rod string 132 and the fluid column load.

In addition to the rod pumping unit, a method of producing oil using a surface rod pumping unit is also provided. In one aspect, the method first comprises providing a surface rod pumping unit. The surface rod pumping unit may be designed in accordance with the rod pumping unit 200 described above, in its various embodiments. For example, the surface rod pumping unit may comprise:

- a horizontal support base;
- a vertical support column residing adjacent the horizontal support base at a generally transverse orientation, the vertical support column having a front face and a back face;
- a sheave fixed proximate an upper end of the vertical support column, serving as a standing sheave;
- a sheave configured to move up and down along the vertical support column, serving as a traveling sheave, and residing along the back face;
- a near-vertical linear actuator residing along the horizontal support base, configured to cycle the traveling sheave up and down the vertical support column along the back face;
- a carrier bar configured to be attached to a polished rod along the front face; and
- at least two ropes connected at a first end to the carrier bar, wound over the standing sheave, then wound under the traveling sheave.

Preferably, the sheave of the standing sheave comprises a pair of wheels rotationally fixed above or to opposing sides of the vertical support column, while the traveling sheave also comprises a pair of wheels, wherein the pair of wheels of the traveling sheave reciprocate along the vertical support column together. The pair of wheels making up the standing sheave rotate together about an axis of rotation through the vertical center-line of the standing sheave, while the pair of wheels making up the traveling sheave rotate together about an axis of rotation through the vertical center-line of the traveling sheave.

Preferably, the wheels of the standing sheave and the wheels of the traveling sheave each have an axle. In an aspect, the axles are stationary while the wheels bearingly rotate about the respective axles.

Preferably, each of the at least two ropes is a wire rope. Each wire rope has a second end opposite the first end that is pinned to the vertical support column proximate an upper end of the vertical support column. In one aspect, a crown is provided at the top of the vertical support column. The crown supports the axle for the standing sheave. The crown also receives pins that hold the distal end of the wire ropes. In this instance, the upper end of the vertical support column is the crown.

In the method, the vertical linear actuator may comprise a first end fixed relative to the horizontal support base, and a second end affixed to the traveling sheave. Of interest, the second end remains in tension at all times during movement of the polished rod. The fixed end may comprise a barrel while the second end is a piston rod. The piston has a plunger that resides within the barrel. Movement of the piston rod is accomplished by applying hydraulic force against the plunger.

The method also includes cycling the linear actuator. In this arrangement, cycling the linear actuator in order to cause the traveling sheave to reciprocate up and down along the vertical support column such that upward movement of the traveling sheave produces a downstroke of the polished rod, while downward movement of the traveling sheave produces an upstroke of the polished rod.

In a preferred arrangement, each of the polished rod, the traveling sheave and the standing sheave has a vertical center-line, with each center-line being offset from the other. In addition, the vertical support column defines a vertical center-line. The center-line of the traveling sheave is proximate the back face of the vertical support column. The center-line of the traveling sheave and the standing sheave are offset from the center-line of the vertical support column so that the wire ropes create side load forces supported by the vertical support column in a generally balanced position throughout the movement cycles.

Preferably, the linear actuator has a distal end that is operatively connected to the traveling sheave. Upward movement of the linear actuator causes the traveling sheave to travel to an upper end of the vertical support column, defining a raised position. In one aspect, when the traveling sheave is in its raised position, the wire ropes form an angle that is between 4° and 8° relative to the center-line of the vertical support column. Downward movement of the linear actuator causes the traveling sheave to travel to a lower end of the vertical support column, defining a lowered position. In one aspect, when the traveling sheave is in its lowered position, the wire ropes form an angle that is between 1° and 4° relative to the center-line of the vertical support column.

Figure 10A:
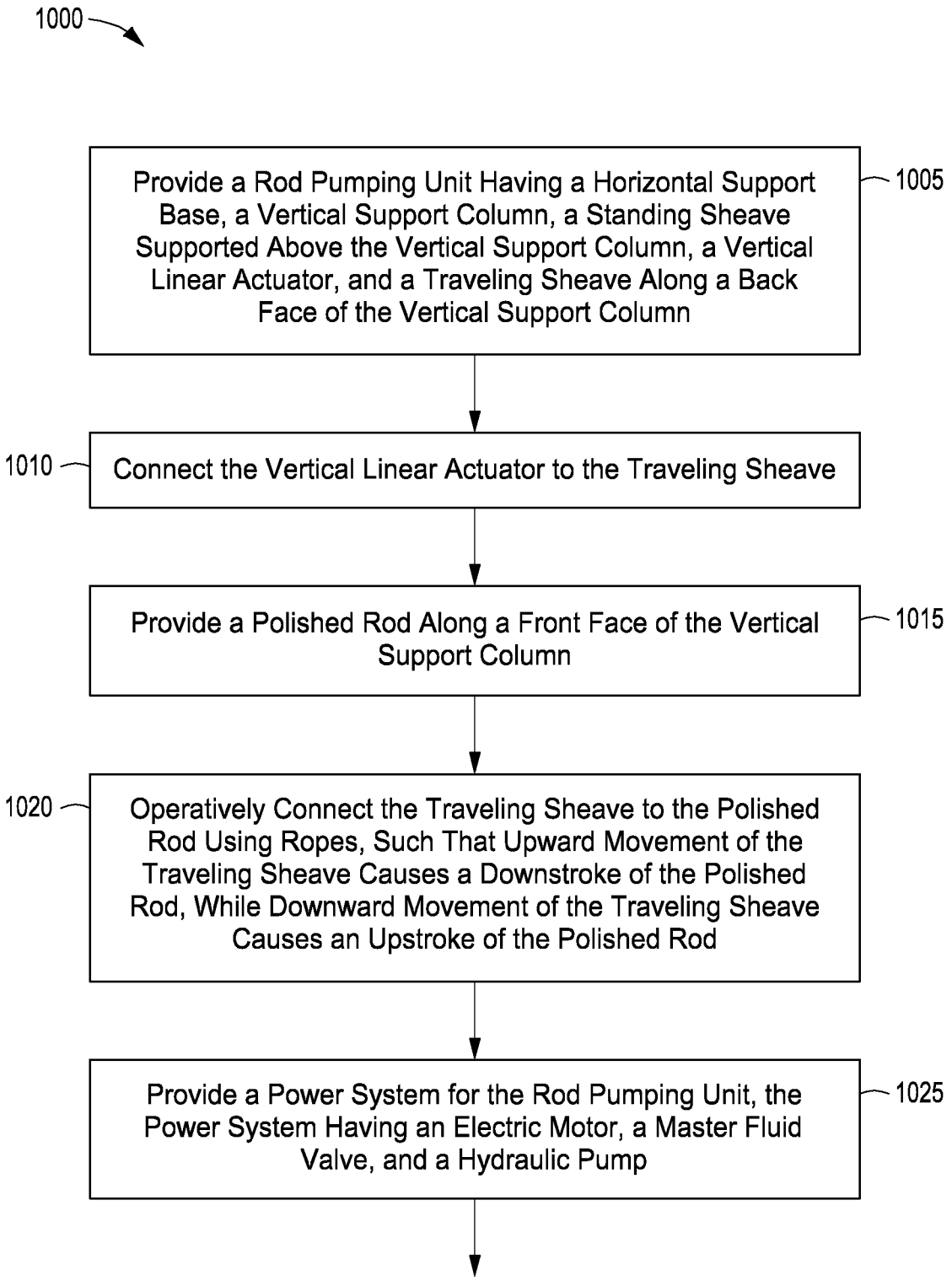
FIGS. 10A, 10B and 10C together represent a flow chart showing operational steps for the master controller of the rod pumping unit, in one illustrative embodiment.
Figure 10B:
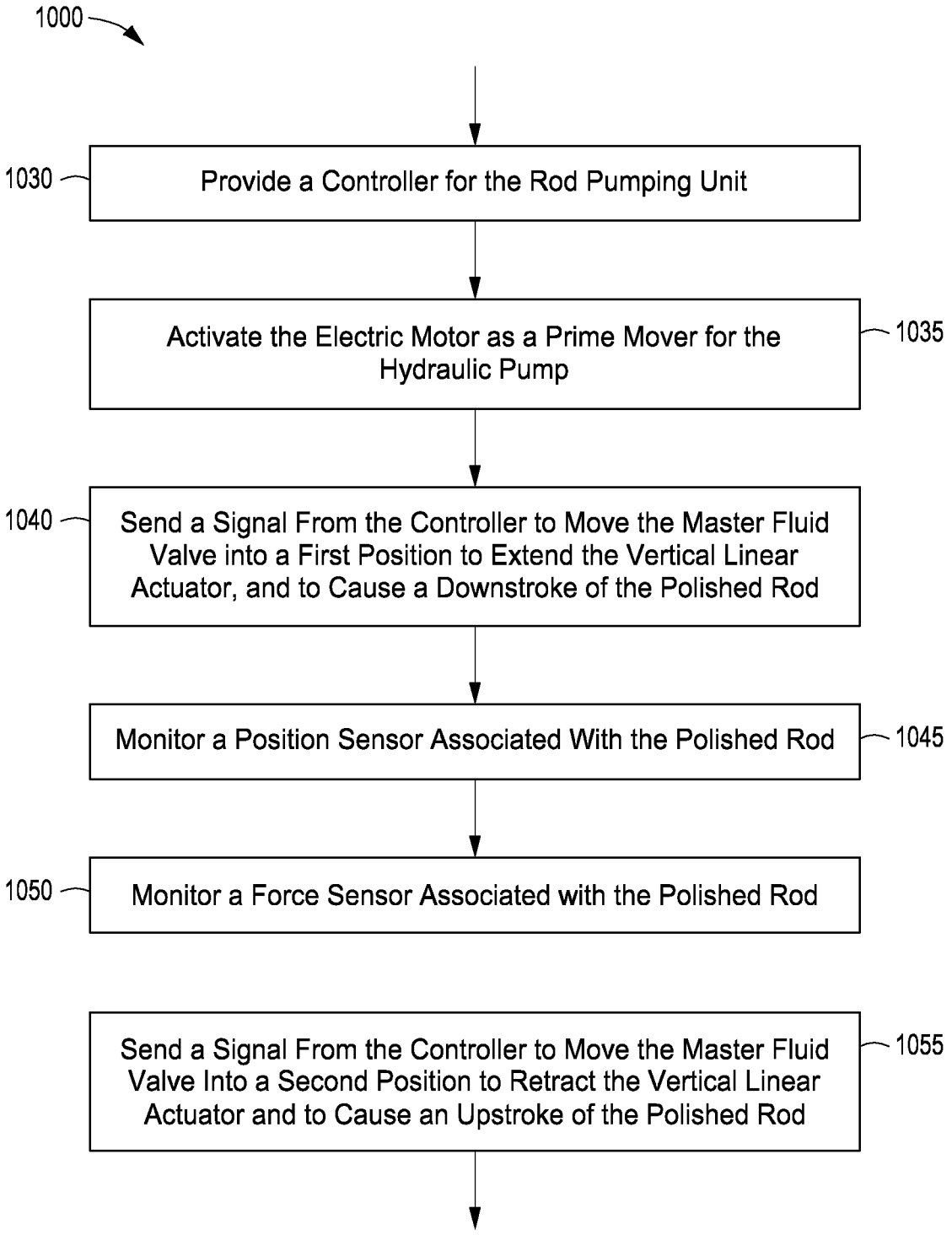
Figure 10C:
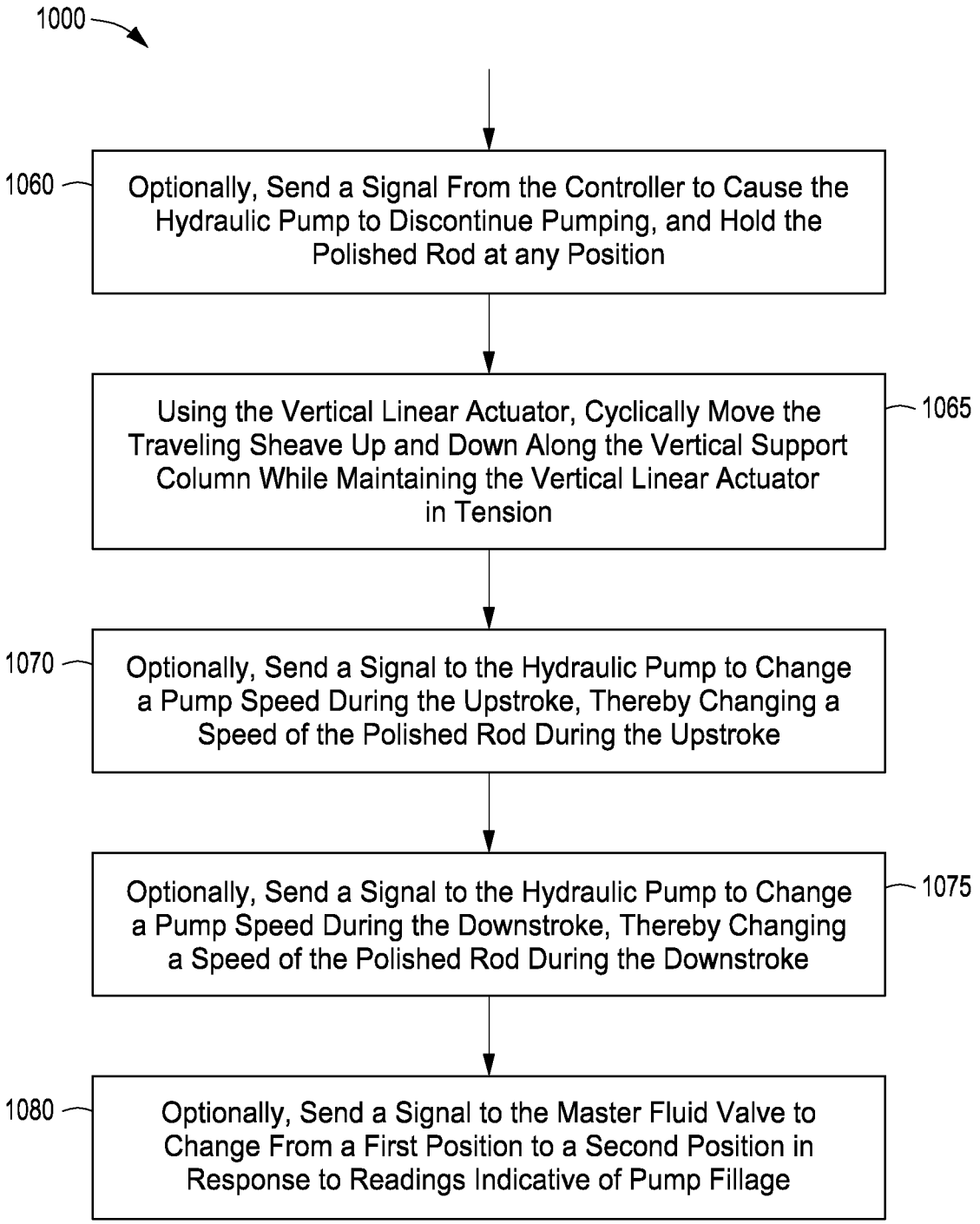

FIGS. 10A, 10B and 10C together represent a flow chart showing steps for a method 1000 for producing hydrocarbon fluids from a wellbore, in one illustrative embodiment. As part of the method 1000, certain operational steps for the rod pumping unit 200 are shown, using the controller 410.

The method 1000 first comprises providing a rod pumping unit for a well. This is shown in Box 1005 of FIG. 10A. The rod pumping unit may be in accordance with unit 200 described above in connection with its various embodiments. For example, the rod pumping unit 200 may have a horizontal support base, a vertical support column, and a vertical linear actuator. In addition, the rod pumping unit 200 will have a standing sheave supported above the vertical support column, and a traveling sheave residing along a back face of the vertical support column opposite the well.

The method 1000 also includes connecting the vertical linear actuator to the traveling sheave. This is provided in Box 1010. Preferably, the vertical linear actuator comprises a hydraulically actuated piston that reciprocates in and out of a barrel. This occurs in response to pressure applied by hydraulic fluid against a plunger. The proximal end of the barrel may be pinned to the horizontal support base using a clevis arrangement. Alternatively, a front trunnion connection may be provided. Similarly, a distal end of the piston may be pinned to an axle of the traveling sheave.

The method 1000 also includes providing a polished rod along a front face of the vertical support column. This is seen in Box 1015. The polished rod is clamped or otherwise connected to a carrier bar such that movement of the carrier bar imparts reciprocating motion to the polished rod.

The method 1000 further comprises operatively connecting the traveling sheave to the polished rod. This step is provided in Box 1020 of FIG. 10A. Connecting the traveling sheave to the polished rod is done so that upward movement of the traveling sheave causes a downstroke of the polished rod, while downward movement of the traveling sheave causes an upstroke of the polished rod. It is understood that in practice, the polished rod will support a rod string and traveling valve of a downhole pump.

In the step of Box 1020, the traveling sheave is operatively connected to the polished rod using a plurality of ropes. The ropes may be pinned at one end to the vertical support column, then be spooled under the traveling sheave, and then over the standing sheave. A distal end of the ropes is then connected to a carrier bar. The carrier bar is clamped to the polished rod as is known in the art of artificial lift.

The method 1000 additionally includes providing a power system. This is seen in Box 1025. The power system is used to reciprocate the polished rod of the rod pumping unit 200. In one aspect, the power system is a hydraulic power system having an electric motor, a master fluid valve, and a hydraulic pump. The hydraulic power system may be either an open loop or a closed loop system. A closed loop system is preferred as it is more energy efficient. Particularly, a closed loop system is able to recoup the kinetic energy generated by the falling polished rod string and re-use it with minimal losses.

The electric motor serves as a prime mover to the hydraulic pump, while a controller 410 controls position of the master fluid valve. Movement of the master fluid valve, in turn, regulates the pump swashplate which directs fluid into and out of the barrel of the near-vertical linear actuator, thereby moving the traveling sheave.

Preferably, actuation of the electric motor and movement of the master fluid valve are controlled by the same controller. Thus, the method 1000 also comprises providing a controller for the rod pumping unit. This is seen in Box 1030 of FIG. 10B. Beneficially, the master fluid valve is capable of providing infinite adjustments between 100%-0%-100% positions for pumping or for releasing hydraulic fluid into the vertical linear actuator in response to commands from the controller 410. At a Zero command, the near-vertical linear actuator is held stationary. Thus, the polished rod may be stopped anywhere between full upstroke and full downstroke positions.

In one aspect, the controller 410 causes the electric motor to move the master fluid valve between an upstroke pumping mode and a downstroke pumping mode. This is provided in the step of Box 1035, which addresses activating the electric motor as a prime mover of the hydraulic pump.

In the upstroke pumping mode, the controller sends a signal to move the master fluid valve into a first position. This is indicated at Box 1040. Hydraulic fluid is pumped through the master fluid valve, through an oil line, into the barrel of the vertical linear actuator, and against the plunger. This pushes the piston of the near-vertical linear actuator into the barrel downward, and produces an upstroke of the polished rod. Note that the first position is infinitely variable.

In the downstroke pumping mode, the controller sends a signal to move the master fluid valve into a second position. This is shown at Box 1055. Hydraulic fluid is released from the barrel and through the oil line, allowing the piston to extend back out of the barrel upward. This, in turn, allows the polished rod to gravitationally fall in a downstroke. Note that this second position is also infinitely variable.

The controller 410 is programmed to know a wide number of variables associated with the rod pumping unit 200. These may include a length of the rod string and a location of the traveling valve in the wellbore. In one aspect, the controller 410 is able detect the dynamic lifting and lowering loads generated by the carrier bar 260 and the polished rod string assembly. At the same time, the controller 410 can monitor actual position of the polished rod string assembly with a high degree of resolution and sample rate while the rod pumping unit is lifting and lowering the polished rod string assembly and fluid column loads. This is indicated at Box 1045. In this way, the controller 410 can move the traveling valve down to within inches of the standing valve during the down stroke. Beneficially, this forces the travelling valve to open more efficiently and helps regulate actual tag force when bottom pump spacing is brought to zero space.

Position feedback may be provided by a location sensor 984 associated with the polished rod 265. The location (or position) sensor 984 may be mounted alongside or even inside the piston rod of the near-vertical linear actuator 250.

The controller 410 also gathers data during the pump cycles related to load. Such data includes both weight transfer position and rate of change during the weight transfer. The step of monitoring a force sensor is shown in Box 1050. The force sensor may be a pressure transducer 982 placed along hose 965, as shown in FIGS. 9B and 9C. Alternatively, the force sensor may be a so-called horseshoe load cell that is placed adjacent the carrier bar 260.

With all this information, the controller 410 is able to optimize pumping performance of the rod pumping unit. The optimization can occur in various ways. These include lifting the polished rod string assembly and fluid column load only as far as required to optimize liquid fillage volume, and then lowering the polished rod string assembly as far as possible to increase gas compression under the traveling valve and plunger assembly within the downhole pump. Note that this also reduces energy usage by the prime mover as the prime mover is not moving the stroke length more than is necessary. Stopping and dwelling at the top of the stroke for a brief instant allows additional downhole pump fillage across the standing valve.

Preferably, the polished rod may be held at any position along the upstroke or the downstroke. This is provided at Box 1060 of FIG. 10C.

In operation, the rod pumping unit uses the near-vertical linear actuator to cyclically move the traveling sheave up and down along the vertical support column. This is shown at Box 1065. In one novel aspect, the vertical linear actuator remains in tension during the entire cycle by virtue of being operatively connected to the polished rod string assembly. Beneficially, the force and position sensors allow the controller 410 to perform autonomous dynamometer testing using the technology of U.S. Pat. No. 8,844,626 discussed above. In another novel aspect, a counter-weight is provided to work with the plunger of the vertical linear actuator. The counter-weight reduces the amount of work required to raise the polished rod during the upstroke pumping mode.

A benefit of the optimization provided by the controller 410 is reducing fluid pound downhole. The controller 410 knows where the polished rod position weight transfer occurred on previous downstrokes. The controller 410 can then adjust a rate of descent of the polished rod assembly during a subsequent downstroke and transition into a slower speed, allowing weight transfer to occur more slowly with less shock caused from the plunger/traveling valve contacting the fluid volume within the working barrel of the down hole pump. This is provided in connection with Box 1070, which shows the controller sending a signal to the hydraulic pump to change a pump speed while lowering the polished rod string into the well. This is done by slowing a rate of release of hydraulic fluid during the fluid releasing mode.

In one aspect, the controller 410 is capable of detecting and accepting current plus previous pumping cycle feedback conditions such as polished rod position, polished rod supported force, and rates of change of polished rod supported force over time. In another aspect, the controller 410 is capable of evaluating performance of the current pump cycle, and then computing and outputting a tailored control signal for optimizing the next pumping cycle(s). Regulating the down stroke motion of the pumping cycle allows for total regenerated energy level output or capture, hence, reducing energy usage. This is provided in connection with Box 1075, which shows the controller sending a signal to the hydraulic pump to change a pump speed during the downstroke.

Optionally, the controller 410 may regulate tagging forces to mechanically assist the traveling valve during extreme gas interference operating wells. The step of Box 1080 demonstrates a signal being sent to the master fluid valve to change from a first position to a second position during the downstroke pumping mode. Having the ability to regulate force of impact at the bottom of the well allows tagging as a reliable method to off seat the traveling valve with minimal damage. These processes can save lifting energy by reducing total travel lifted or speed of lifting thru the travel distance plus managing energy levels, both input and output energy flow.

In one aspect, the controller is configured to control movement of the polished rod by sending a signal to the hydraulic pump to (i) increase a pump rate during an upstroke pumping mode, thereby increasing a speed of the upstroke; (ii) decrease a pump rate during the upstroke pumping mode, thereby decreasing a speed of the upstroke; and (iii) stop pumping during an upstroke or during a downstroke, thereby holding the polished rod in a fixed position.

In another aspect, the controller receives signals from the position sensor and the load sensor and, in response, adjusts (i) a speed of the upstroke of the polished rod, (ii) a speed of the downstroke of the polished rod, (iii) a length of the upstroke; (iv) a length of the downstroke; and any time delay at the top of pump intake movement.

In summary, the controller 410 is capable of commanding the rod pumping unit 200 how far to lift, how fast to lift, whether to dwell at the top of stroke, how fast to lower, one or more speeds to lower, distance to lower at selected speed and how far to lower in that current pump stroke cycle.

The particular embodiments disclosed above are illustrative only, as the embodiments may be modified and practiced in different but equivalent manners apparent to those skilled in the art having the benefit of the teachings herein. It is therefore evident that the particular embodiments disclosed above may be altered or modified, and all such variations are considered within the scope and spirit of the application. For example, instead of using a hydraulic piston-and-barrel arrangement for the linear actuator, the linear actuator may be any of:

- a rotary ball screw linear actuator using either a synchronous or an asynchronous rotary electric motor;
- a rotary roller screw linear actuator using either a synchronous or an asynchronous rotary electric motor;
- a linear electric motor; or
- a rotary rack and pinion linear actuator along with a mechanical gear train, using either a synchronous or an asynchronous rotary electric motor.

It is understood that these items could also be driven by an internal combustion engine. However, it is preferred to use a variable displacement over-center type pump due to ease of starting, stopping, controlling direction, controlling velocity or variable velocity including controlled accelerations and decelerations in addition to limiting maximum pressure levels of discharge fluid and regulating minimum pressure levels during low side intake fluid pressure levels.

It is also noted that the present inventions are not limited by the top of rod pump controller used for cycling the polished rod and supported traveling valve. Numerous examples of controllers for optimizing pump rate and/or stroke length exist, such as those described in U.S. Pat. No. 11,162,331 (entitled "System and Method for Controlling Oil and Gas Production"); U.S. Pat. No. 10,947,833 (entitled "Diagnostics of Downhole Dynamometer Data for Control and Troubleshooting of Reciprocating Rod Lift Systems"); and U.S. Pat. No. 10,422,205 (entitled "Low Profile Rod Pumping Unit With Pneumatic Counterbalance for the active Control of the Rod String"). Each of these patents is incorporated herein by reference in its entirety.

In the claims which follow, the word "comprising" is used in its inclusive sense and does not exclude other elements being present. The indefinite articles "a" and "an" before a claim feature do not exclude more than one of the feature being present. Each one of the individual features described here may be used in one or more embodiments and is not, by virtue only of being described here, to be construed as essential to all embodiments as defined by the claims.

I claim:

1. An oil well pumping unit, comprising:

a vertical support column having a front face and a back face;

a polished rod residing along and spaced apart from the front face of the vertical support column;

a first sheave fixed at an upper end of the vertical support column, serving as a standing sheave;

a carrier bar attached to and supporting the polished rod along the front face of the vertical support column below the standing sheave;

a second sheave residing along the back face of the vertical support column, serving as a traveling sheave;

a near-vertical linear reciprocating piston connected to the traveling sheave and also residing along the back face of the vertical support column; and at least two ropes, with each of the at least two ropes being pinned at a first end to the carrier bar, then wound over the standing sheave, then wound under the traveling sheave, and then pinned at a second end to the vertical support column;

wherein:

each of the vertical support column, the traveling sheave and the standing sheave has a vertical center-line, with each vertical center-line being offset from the other; and the oil well pumping unit is configured to, in response to cyclical movement of the near-vertical linear reciprocating piston, cause the traveling sheave to reciprocate up and down along the vertical support column such that upward movement of the traveling sheave uncoils the at least two ropes from the traveling sheave to produce a downstroke of the polished rod, while downward movement of the traveling sheave pulls the at least two ropes downward along the traveling sheave to produce an upstroke of the polished rod.

2. The oil well pumping unit of claim 1, further comprising:

a horizontal support base;

and wherein the oil well pumping unit is configured such that:

the vertical support column resides adjacent the horizontal support base at a generally transverse orientation when the vertical support column is pivoted into a raised position;

the near-vertical linear reciprocating piston has a first end pinned above the horizontal support base, and a second end operatively connected to the traveling sheave; and the second end of the near-vertical linear reciprocating piston remains in tension at all times during movement of the polished rod.

3. The oil well pumping unit of claim 2, wherein:
the vertical support column comprises a crown at the upper end of the vertical support column; and
the crown supports the standing sheave.

4. The oil well pumping unit of claim 3, wherein the center-lines of the traveling sheave and the standing sheave are offset from the center-line of the vertical support column in such a manner that the ropes create balanced side load forces supported by the vertical support column during cycling of the near-vertical linear reciprocating piston.

5. The oil well pumping unit of claim 4, wherein:
the center-line of the traveling sheave resides along the back face of the vertical support column; and
the second end of each of the at least two ropes is pinned to the vertical support column at the crown.

6. The oil well pumping unit of claim 4, wherein:
each rope has a first angle of deviation defined by the angle of the rope as it approaches the traveling sheave relative to the center-line of the vertical support column;
each rope also has a second angle of deviation defined by the angle of the rope as it exits the traveling sheave relative to the center-line of the vertical support column; and
the first angle and the second angle have values that are within 10 degrees of each other regardless of the position of the traveling sheave along the vertical support column.

7. The oil well pumping unit of claim 5, wherein:
the first end of the near-vertical linear reciprocating piston comprises a hydraulic cylinder pivotally supported above the horizontal support base,
the second end of the near-vertical linear reciprocating piston comprises a piston rod extending from the hydraulic cylinder and affixed to the traveling sheave; and
cyclical movement of the traveling sheave is imparted by cyclical movement of the piston rod in response to fluid pressure produced by a hydraulic pump.

8. The oil well pumping system of claim 7, wherein:
the standing sheave comprises a pair of wheels rotationally residing on opposing sides of the vertical support column;
the traveling sheave comprises a pair of wheels having an axle, wherein the pair of wheels of the traveling sheave reciprocate along the vertical support column together;
each of the wheels of the pair of wheels of the standing sheave receives one of the at least two ropes; and
each of the wheels of the pair of wheels of the traveling sheave also receives one of the at least two ropes.

9. The oil well pumping unit of claim 2, wherein:
the traveling sheave comprises a pair of wheels having a shared axle, wherein the pair of wheels of the traveling sheave reciprocate along the vertical support column together;
the near-vertical linear reciprocating piston comprises a mechanical actuator which takes in rotary motion and outputs linear motion, with the mechanical actuator having a first end fixed relative to the horizontal support base, and a second end affixed to the axle of the traveling sheave; and
the mechanical actuator is powered by an electric motor.

10. The oil well pumping unit of claim 8, wherein:
each of the at least two ropes comprises wire ropes; and
a distal end of the piston rod is affixed to the axle of the pair of wheels making up the traveling sheave.

11. The oil well pumping unit of claim 10, further comprising:
a controller programmed to control reciprocal motion of the polished rod by controlling the downstroke speed of the polished rod within established minimum and maximum downstroke speeds, and controlling the upstroke speed of the polished rod within established minimum and maximum upstroke speeds.

12. The oil well pumping unit of claim 11, wherein the controller is further programmed to control movement of the near-vertical linear reciprocating piston by sending command signals to (i) start and stop movement of the near-vertical linear reciprocating piston, and (ii) hold a position of the near-vertical linear reciprocating piston.

13. The oil well pumping unit of claim 11, wherein:
the polished rod supports a rod string and downhole pump; and
the controller is further programmed to control movement of the near-vertical linear reciprocating piston so as (i) to adjust a length of the stroke of the polished rod, and (ii) to adjust the location of top-of-travel of the downhole pump.

14. The oil well pumping unit of claim 5, wherein:
the standing sheave comprises a pair of wheels rotationally residing on opposing sides of the vertical support column;
the traveling sheave comprises a pair of wheels having a shared axle, wherein the pair of wheels of the traveling sheave reciprocate along the vertical support column together;
each of the wheels of the pair of wheels of the standing sheave receives one of the at least two ropes; and
each of the wheels of the pair of wheels of the traveling sheave also receives one of the at least two ropes;
the pair of wheels making up the standing sheave rotate together about an axis of rotation through the vertical center-line of the standing sheave; and
the pair of wheels making up the traveling sheave rotate together about an axis of rotation through the vertical center-line of the traveling sheave.

15. The oil well pumping unit of claim 14, wherein each of the wheels making up the standing sheave has a radius that is larger than a radius of each of the wheels of the traveling sheave.

16. The oil well pumping unit of claim 2, wherein:
the vertical support column is connected to the horizontal support base by means of a hinged connection, such that the vertical support column is configured to be folded over into a horizontal orientation on top of the horizontal support base.

17. The oil well pumping unit of claim 16, wherein:
the vertical support column comprises a base plate and at least one support plate secured to the base plate;
the hinged connection between the horizontal support base and the vertical support column is operatively connected to the at least one support plate; and
the oil well pumping unit further comprises:
a near-horizontal linear reciprocating piston residing along the horizontal support base, wherein the near-horizontal linear reciprocating piston has a first end pinned to the horizontal support base and a second end pinned to the base plate of the vertical support column; and
the oil well pumping unit is further configured such that rotation of the vertical support column onto and off of the horizontal support base is controlled at least in part by movement of the near-horizontal linear reciprocating piston.

18. The oil well pumping unit of claim 17, wherein:

each of the near-vertical linear reciprocating piston and the near-horizontal linear actuator reciprocating piston is powered by a hydraulic pump.

19. The oil well pumping unit of claim 18, wherein the oil well pumping unit is further configured such that the near-vertical linear reciprocating piston is tilted at a one-to-four degree angle into the vertical support column when the vertical support column is rotated into its transverse position relative to the horizontal support base.

20. A method of producing oil, comprising:

providing an oil well pumping unit comprising:

a horizontal support base;

a vertical support column residing adjacent the horizontal support base at a generally transverse orientation, the vertical support column having a front face and a back face;

a polished rod residing along and spaced apart from the front face of the vertical support column;

a first sheave fixed at an upper end of the vertical support column, serving as a standing sheave;

a carrier bar attached to and supporting the polished rod along the front face of the vertical support column below the first sheave;

a second sheave residing along the back face of the vertical support column, serving as a traveling;

a near-vertical linear reciprocating piston residing along the horizontal support base, having a first end pinned above the horizontal support base, and a second end operatively connected to the traveling sheave; and at least two ropes, with each of the at least two ropes being pinned at a first end to the carrier bar, then wound over the standing sheave, then wound under the traveling sheave, and then pinned at a second end to the vertical support column;

wherein each of the vertical support column, the traveling sheave and the standing sheave has a vertical center-line, with each vertical center-line being offset from the other; and cycling the near-vertical linear reciprocating piston in order to cause the traveling sheave to reciprocate up and down along the vertical support column such that upward movement of the traveling sheave uncoils the at least two ropes from the traveling sheave to produce a downstroke of the polished rod, while downward movement of the traveling sheave winds the at least two ropes along the traveling sheave to produce an upstroke of the polished rod.

21. The method of claim 20, wherein:

the near-vertical linear reciprocating piston has a first end pinned above the horizontal support base, and second end operatively connected to the traveling sheave; and the second end of the near-vertical linear reciprocating piston remains in tension at all times during movement of the polished rod.

22. The method of claim 21, wherein:

each rope has a first angle of deviation defined by the angle of the rope as it approaches the traveling sheave relative to the center-line of the vertical support column;

each rope also has a second angle of deviation defined by the angle of the rope as it exits the traveling sheave relative to the center-line of the vertical support column; and the first angle and the second angle have values that are within 10 degrees of each other regardless of the position of the traveling sheave along the vertical support column.

23. The method of claim 21, wherein:

the first end of the near-vertical linear actuator reciprocating piston comprises a hydraulic cylinder;

the second end of the near-vertical linear reciprocating piston comprises a rod extending from the hydraulic cylinder, and affixed to the traveling sheave; and cyclical movement of the traveling sheave is imparted by cyclical movement of the rod in response to fluid pressure produced by a fluid pump.

24. The method of claim 23, wherein:

the standing sheave comprises a pair of wheels rotationally connected to opposing sides of the vertical support column;

the traveling sheave comprises a pair of wheels having an axle, wherein the pair of wheels of the traveling sheave reciprocate along the vertical support column together;

each of the wheels of the pair of wheels of the standing sheave receives one of the at least two ropes;

each of the wheels of the pair of wheels of the traveling sheave also receives the at least two ropes;

each of the at least two ropes comprises wire ropes; and the second end of the near-vertical linear reciprocating piston is operatively connected to the axle of the pair of wheels making up the traveling sheave.

25. The method of claim 24, further comprising:

a controller programmed to control reciprocal motion of the polished rod through control of the fluid pump.

26. The method of claim 25, wherein the controller is programmed to control movement of the near-vertical linear reciprocating piston by sending signals to (i) start and stop movement of the near-vertical linear reciprocating piston, (ii) hold a position of the near-vertical linear reciprocating piston, and (iii) control a speed of the upstroke of the polished rod, a speed of the downstroke of the polished rod, or both.

27. The method of claim 24, wherein:

the pair of wheels making up the standing sheave rotate together about an axis of rotation through the vertical center-line of the standing sheave; and the pair of wheels making up the traveling sheave rotate together about an axis of rotation through the vertical center-line of the traveling sheave.

28. The method of claim 24, wherein:

the vertical support column is connected to the horizontal support base by means of a hinged connection; and the method further comprises:

folding the vertical support column over into a horizontal orientation on top of the horizontal support base using the hinged connection.

29. A rod pumping unit, comprising:

a horizontal support base;

a vertical support column residing adjacent the horizontal support base at a generally transverse orientation, the vertical support column having a front face and a back face;

a polished rod residing along and spaced apart from the front face of the vertical support column, a carrier bar attached to and supporting the polished rod along the front face of the vertical support column;

a near-vertical linear reciprocating piston residing along the back face of the vertical support column, with the near-vertical linear reciprocating piston having a first end pinned above the horizontal support base, and a distal end and operatively connected to the polished rod;

at least two ropes each having a first end and a second end, with the first end of each rope being connected to the carrier bar, and the second end of each rope being pinned to the vertical support column at the upper end of the vertical support column;

a first sheave fixed at the upper end of the vertical support column, serving as a standing sheave and receiving the at least two ropes; and a second sheave configured to move up and down along the vertical support column in response to movement of the second end of the near-vertical linear reciprocating piston, serving as a traveling sheave;

wherein:

each of the polished rod, the traveling sheave and the standing sheave has a vertical center-line, with each vertical center-line being offset from the other;

the rod pumping unit is configured such that cyclical movement of the near-vertical linear reciprocating piston causes the carrier bar to reciprocate up and down along the vertical support column such that upward movement of the near-vertical linear reciprocating piston uncoils the at least two ropes from the traveling sheave to produce a downstroke of the polished rod, while downward movement of the near-vertical linear reciprocating piston winds the at least two ropes along the traveling sheave to produce an upstroke of the polished rod;

and the distal end of the near-vertical linear reciprocating piston remains in tension at all times during movement of the polished rod.

30. The rod pumping unit of claim 29, wherein:

the center-line of the traveling sheave resides along the back face of the vertical support column; and the distal end of the near-vertical linear reciprocating piston is operatively connected to the polished rod by means of the carrier bar, the traveling sheave, and the at least two ropes.

31. The rod pumping unit of claim 30, wherein a stroke length of the polished rod as moved by the near-vertical linear reciprocating piston is at least 400 inches.

32. The rod pumping unit of claim 30, wherein:

the vertical support column also has a vertical center-line; and the center-lines of the traveling sheave and the standing sheave are also offset from the center-line of the vertical support column so that the wire ropes create balanced side load forces supported by the vertical support column during cycling of the near-vertical linear reciprocating piston.

33. The rod pumping unit of claim 32, wherein:

each rope has a first angle of deviation defined by the angle of the rope as it approaches the traveling sheave relative to the center-line of the vertical support column;

each rope also has a second angle of deviation defined by the angle of the rope as it exits the traveling sheave relative to the center-line of the vertical support column; and the first angle and the second angle have values that are within 10 degrees of each other regardless of the position of the traveling sheave along the vertical support column.

34. The rod pumping unit of claim 33, wherein the rod pumping unit is configured such that:

upward movement of the near-vertical linear reciprocating piston causes the traveling sheave to travel to an upper end of the vertical support column, defining a raised position; and when the traveling sheave is in its raised position, the wire ropes form an angle that is between 4° and 8° relative to the center-line of the vertical support column.

35. The rod pumping unit of claim 33, wherein the rod pumping unit is configured such that:

downward movement of the near-vertical linear reciprocating piston causes the traveling sheave to travel to a lower end of the vertical support column, defining a lowered position; and when the traveling sheave is in its lowered position, the wire ropes form an angle that is between 1° and 4° relative to the center-line of the vertical support column.

36. The rod pumping unit of claim 35, wherein:

the vertical support column comprises a crown at the upper end of the vertical support column;

the crown supports the standing sheave; and the second end of each of the at least two ropes is pinned to the vertical support column at the crown.

37. The rod pumping unit of claim 35, wherein the rod pumping unit is further configured such that the near-vertical linear reciprocating piston is tilted at a one-to-four degree angle into the vertical support column when the vertical support column is rotated into its transverse position relative to the horizontal support base.

* * * * *